US011139563B2

(12) United States Patent
Hamabe

(10) Patent No.: US 11,139,563 B2
(45) Date of Patent: Oct. 5, 2021

(54) ANTENNA DEVICE

(71) Applicant: Panasonic Intellectual Property Management Co., Ltd., Osaka (JP)

(72) Inventor: Taichi Hamabe, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 77 days.

(21) Appl. No.: 16/709,018

(22) Filed: Dec. 10, 2019

(65) Prior Publication Data

US 2020/0112088 A1 Apr. 9, 2020

Related U.S. Application Data

(63) Continuation of application No. PCT/JP2018/021635, filed on Jun. 6, 2018.

(30) Foreign Application Priority Data

Jun. 28, 2017 (JP) ..... JP2017-125965

(51) Int. Cl.
*H01Q 1/24* (2006.01)
*H01Q 1/38* (2006.01)
(Continued)

(52) U.S. Cl.
CPC ..... *H01Q 1/38* (2013.01); *H01Q 1/48* (2013.01); *H01Q 7/06* (2013.01); *H01Q 9/30* (2013.01); *H01Q 15/008* (2013.01)

(58) Field of Classification Search
CPC ..... H01Q 15/006; H01Q 15/008; H01Q 1/38; H01Q 1/48; H01Q 7/06; H01Q 9/285; H01Q 9/30
See application file for complete search history.

(56) References Cited

U.S. PATENT DOCUMENTS 8,976,078 B2 * 3/2015 De Rosny ..... H01Q 3/44 343/909
9,531,077 B1 * 12/2016 Weller ..... H01Q 9/065
(Continued)

FOREIGN PATENT DOCUMENTS

JP 2015-70542 4/2015

OTHER PUBLICATIONS

International Search Report dated Sep. 4, 2018 in International (PCT) Application No. PCT/JP2018/021635.
(Continued)

*Primary Examiner* — Thien M Le
(74) *Attorney, Agent, or Firm* — Wenderoth, Lind & Ponack, L.L.P.

(57) ABSTRACT

An antenna device includes at least one antenna conductor, at least one ground conductor, and an artificial magnetic conductor that is located between the at least one antenna conductor and the at least one ground conductor and is disposed separately from the at least one antenna conductor and the at least one ground conductor. At least one of the artificial magnetic conductor and the at least one ground conductor includes at least one opening formed at a place substantially facing a distal-side end of the at least one antenna conductor, the distal-side end of the at least one antenna conductor being opposite a feeder-side end of the at least one antenna conductor.

12 Claims, 16 Drawing Sheets

(51) Int. Cl.

| | |
|---|---|
| ***H01Q 1/48*** | (2006.01) |
| ***H01Q 7/06*** | (2006.01) |
| ***H01Q 9/30*** | (2006.01) |
| ***H01Q 15/00*** | (2006.01) |

(56) References Cited

U.S. PATENT DOCUMENTS

| | | | | |
|---|---|---|---|---|
| 9,780,434 | B1 * | 10/2017 | Weller | H01Q 1/38 |
| 2010/0109966 | A1 * | 5/2010 | Mateychuk | H01Q 1/38<br>343/841 |
| 2011/0122018 | A1 * | 5/2011 | Tarng | G01S 7/03<br>342/179 |
| 2016/0352016 | A1 * | 12/2016 | Ito | H01Q 7/00 |
| 2017/0194716 | A1 * | 7/2017 | Kirino | H01Q 13/10 |
| 2017/0302246 | A1 * | 10/2017 | Ishizuka | H04B 1/0458 |
| 2018/0301815 | A1 * | 10/2018 | Kamo | G01S 13/931 |

OTHER PUBLICATIONS

Ryo Ikeuchi et al., "SAR and Radiation Characteristics of Dipole Antenna above Finite EBG Substrate inPresence of Cubic Head Model", International Symposium on Electromagnetic Compatibility—EMC Europe, IEEE, Sep. 17, 2012.

* cited by examiner

ANTENNA DEVICE

2. Description of the Related Art

PTL (Patent Literature) 1 Unexamined Japanese Patent Publication No. 2015-70542 discloses an antenna device that includes an artificial magnetic conductor (hereinafter referred to as an AMC).

BACKGROUND

1. Technical Field

The present invention relates to an antenna device.

SUMMARY

The present disclosure provides an antenna device that is capable of reducing influence of harmonics while maintaining a frequency response for fundamental waves.

An antenna device according to an aspect of the present disclosure includes at least one antenna conductor, at least one ground conductor, and an artificial magnetic conductor that is located between the at least one antenna conductor and the at least one ground conductor and is disposed separately from the at least one antenna conductor and the at least one ground conductor. At least one of the artificial magnetic conductor and the at least one ground conductor includes at least one opening formed at a place substantially facing a distal-side end of the at least one antenna conductor, the distal-side end being opposite a feeder-side end of the at least one antenna conductor.

An antenna device according to the present disclosure is capable of reducing influence of harmonics while maintaining a frequency response for fundamental waves.

DETAILED DESCRIPTION

Exemplary embodiments will be described in detail below with reference to the drawings as appropriate. However, in some cases, an unnecessarily detailed description may be omitted. For example, detailed description of well-known matters and redundant description of structures that are substantially the same may be omitted. This is to avoid unnecessary redundancy in the following description and to facilitate understanding by those skilled in the art.

It is noted that the accompanying drawings and the description below are provided to enable those skilled in the art to fully understand the present disclosure, and are not intended to limit the subject matters described in the claims.

Antenna devices according to exemplary embodiments, modification examples, and comparative examples described below are, for example, antenna devices designed for 2.4 GHz band (e.g., 2,400 MHz to 2,500 MHz) such as antenna devices intended for Bluetooth (registered trademark), Wireless Fidelity (Wi-Fi), or various electronic devices. However, the technique can be applied similarly to antenna devices designed for other frequency bands.

First Exemplary Embodiment

With Reference to FIGS. 1 to 5, a Configuration of Antenna Device 101 according to a first exemplary embodiment will now be described.

Figure 1:
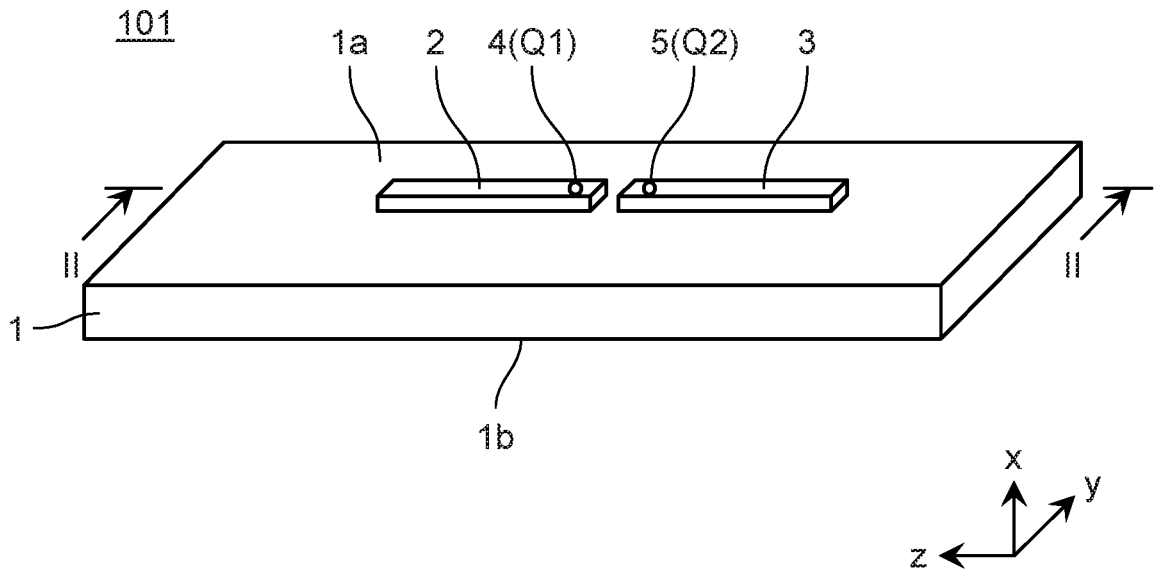
FIG. 1 is an external perspective view illustrating antenna device 101 according to a first exemplary embodiment.
Figure 2:
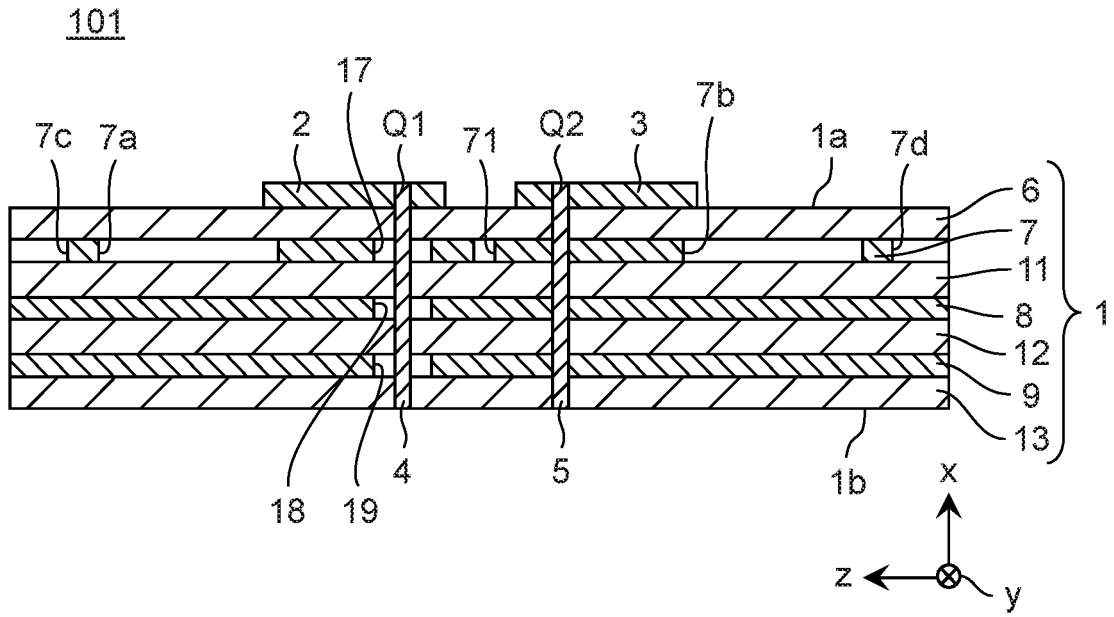
FIG. 2 is a longitudinal sectional view taken from line II-II of FIG. 1.
Figure 3:
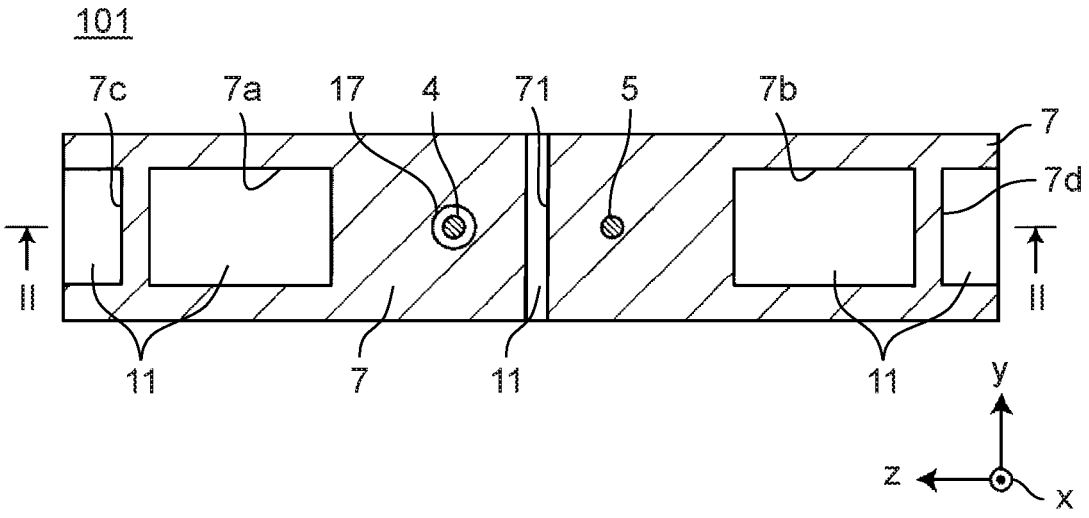
FIG. 3 is a plan view of antenna device 101 of FIG. 2, omitting layers upper than AMC 7.
Figure 4:
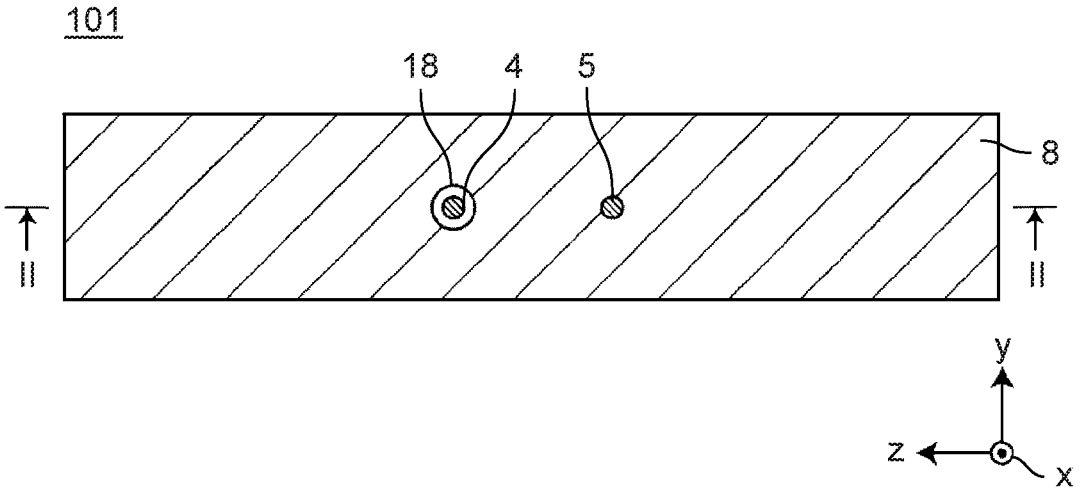
FIG. 4 is a plan view of antenna device 101 of FIG. 2, omitting layers upper than ground conductor 8.
Figure 5:
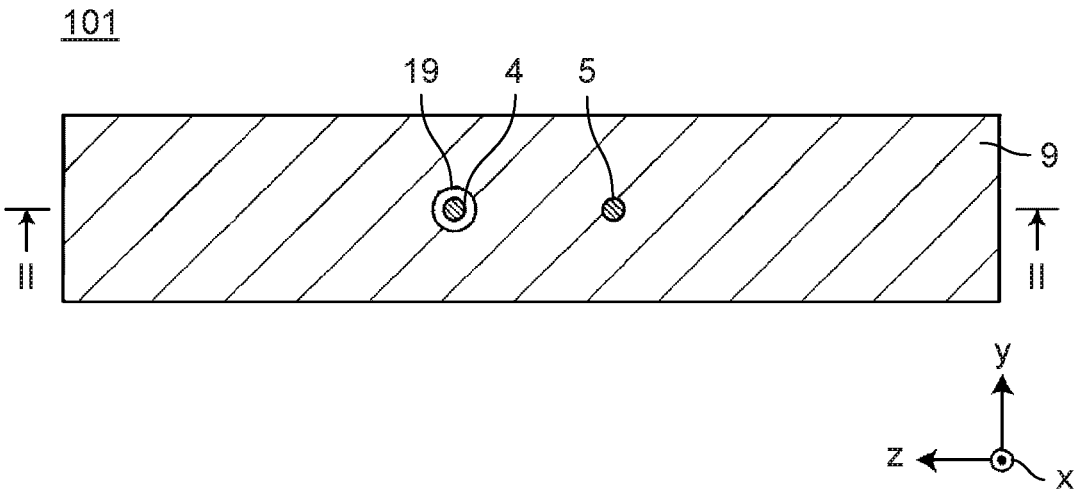
FIG. 5 is a plan view of antenna device 101 of FIG. 2, omitting layers upper than ground conductor 9.

FIG. 1 is an external perspective view illustrating antenna device 101 according to the first exemplary embodiment. FIG. 2 is a longitudinal sectional view taken from line II-II of FIG. 1. FIG. 3 is a plan view of antenna device 101 of FIG. 2, omitting layers upper than AMC 7 (a positive side in an x-direction corresponds to the upper side). FIG. 4 is a plan view of antenna device 101 of FIG. 2, omitting layers upper than ground conductor 8, and FIG. 5 is a plan view of antenna device 101 of FIG. 2, omitting layers upper than ground conductor 9.

In the exemplary embodiments, modification examples, and comparative examples described below, the antenna device is, for example, a dipole antenna (a monopole antenna in a fifth modification example). The dipole antenna and the monopole antenna are each formed on printed wiring board 1 that is a multilayer substrate having a plurality of layers. A pattern for each of the dipole antenna and the monopole antenna is formed by etching or other technique applied to a metallic foil surface of the printed wiring board. The layers are each made of copper foil, glass epoxy, or other material.

As shown in FIG. 1, antenna device 101 includes printed wiring board 1, antenna conductor 2 that is a strip conductor as an example feed antenna, and antenna conductor 3 that is a strip conductor as an example parasitic antenna. Antenna conductor 2 and antenna conductor 3 are connected respectively to via conductor 4 and via conductor 5 in printed wiring board 1. Via conductor 4 constitutes a feeder wire between feedpoint Q1 of antenna conductor 2 and a wireless communication circuit (not shown; that is mounted on back surface 1*b* of printed wiring board 1). Via conductor 5 constitutes a ground wire between feedpoint Q2 of antenna conductor 3 and the wireless communication circuit.

Antenna conductor 2 and antenna conductor 3, for example, constitute a dipole antenna, extending longitudinally on a straight line toward a positive side and a negative side in a z-direction. The dipole antenna is formed on front surface 1*a* of printed wiring board 1 such that ends of antenna conductors 2, 3 adjacent to feedpoints Q1, Q2 (hereinafter referred to as feeder-side ends) are separated from each other at a predetermined distance. Ends opposite the feeder-side ends of antenna conductors 2, 3 (that are separated from each other at a largest distance in a plan view of antenna device 101) are hereinafter referred to as distal-side ends of antenna conductors 2, 3.

As shown in FIG. 2, via conductors 4, 5 are formed by filling conductors into through-holes that are formed from front surface 1*a* to back surface 1*b* of printed wiring board 1 in a thickness direction. Antenna conductor 2 is connected to a power feed terminal of the above-described wireless communication circuit on back surface 1*b* of printed wiring board 1 through via conductor 4 to function as a feed antenna. Antenna conductor 3 is connected to ground conductors 8, 9 in printed wiring board 1 and a ground terminal of the wireless communication circuit through via conductor 5 to function as a parasitic antenna.

In the description herein, a z-axis direction represents a longitudinal direction of antenna device 101 and antenna conductors 2, 3 of the antenna device. A y-axis direction represents a width direction of antenna device 101 and antenna conductors 2, 3 of the antenna device and is orthogonal to the z-axis direction. An x-axis direction represents a thickness direction of antenna device 101 and is orthogonal to an yz-plane. In printed wiring board 1, via conductors 4, 5 are formed at places that are directly below respective feedpoints Q1, Q2 and that substantially face each other. Printed wiring board 1 of antenna device 101 may be mounted on a printed wiring board in an electronic device, for example.

In FIG. 2, printed wiring board 1, a multilayer substrate, includes dielectric substrate 6, AMC 7, dielectric substrate 11, ground conductor 8, dielectric substrate 12, ground conductor 9, and dielectric substrate 13 that are stacked in this order. Dielectric substrates 6, 11, 12, 13 are, for example, made of a material such as glass epoxy. AMC 7 is an artificial magnetic conductor that possesses perfect magnetic conductor (PMC) properties and forms a predetermined metallic pattern. Use of AMC 7 enables the antenna device to achieve a reduction in thickness and an increase in gain.

Via conductor 4 is a cylindrical feeder wire that is used to supply electric power for driving antenna conductor 2 as an antenna and that electrically connects antenna conductor 2 formed on front surface 1*a* of printed wiring board 1 with the power feed terminal of the above-described wireless communication circuit. To ensure that via conductor 4 is not electrically connected with AMC 7 and ground conductors 8, 9, via conductor 4 is formed so as to be substantially concentric with via conductor insulating holes 17, 18, 19 that are formed in AMC 7 and ground conductors 8, 9, and a diameter of via conductor 4 is smaller than a diameter of via conductor insulating holes 17, 18, 19.

Meanwhile, via conductor 5 is used to electrically connect antenna conductor 3 with the ground terminal of the wireless communication circuit and is electrically connected with ground conductors 8, 9 and AMC 7.

As shown in FIGS. 2 and 3, AMC 7 includes:

(1) rectangular opening 7*a* (an opening passing through a layer of AMC 7 in the thickness direction and not being formed in layers other than the AMC 7 layer in the thickness direction in FIG. 2) that is formed so as to extend from near a place being directly below and substantially facing the distal-side end of antenna conductor 2 to have a predetermined width in the width direction and a predetermined length toward the positive side in the longitudinal z-direction;

(2) rectangular opening 7*c* (an opening passing through the layer of AMC 7 in the thickness direction and not being formed in layers other than the AMC 7 layer in the thickness direction in FIG. 2) that is formed so as to extend from a place being separated from opening 7*a* at a predetermined distance toward the positive side in the longitudinal z-direction to have a predetermined width in the width direction and a length reaching a left end of printed wiring board 1 in the z-direction;

(3) rectangular opening 7*b* (an opening passing through the layer of AMC 7 in the thickness direction and not being formed in upper and lower layers other than the AMC 7 layer in the thickness direction in FIG. 2) that is formed so as to extend from near a place being directly below and substantially facing the distal-side end of antenna conductor 3 to have a predetermined width in the width direction and a predetermined length toward the negative side in the longitudinal z-direction;

(4) rectangular opening 7*d* (an opening passing through the layer of AMC 7 in the thickness direction and not being formed in layers other than the AMC 7 layer in the thickness direction in FIG. 2) that is formed so as to extend from a place being separated from opening 7*b* at a predetermined distance toward the negative side in the longitudinal z-direction to have a predetermined width in the width direction and a length reaching a right end of printed wiring board 1 in the negative z-direction; and (5) slit 71 formed at a middle in the z-axis direction so as to pass through the layer in the thickness direction and extend to ends in the width direction.

Openings 7*a* to 7*d* and slit 71 (as well as openings and slits according to exemplary embodiments and modification examples described later) are, for example, openings such as slits, slots, through-holes, and cutouts, and are areas where no artificial magnetic conductors are formed in the layer of AMC 7. AMC 7 is divided into two parts by slit 71 in the longitudinal direction (such a part of the AMC is referred to as an "AMC part" in some cases). In a similar way that the AMC is divided by slit 71 in the longitudinal direction, AMCs in second and third exemplary embodiments, modification examples, and comparative examples described later are divided.

A site where opening 7*a* is formed includes a place being directly below and substantially facing the distal-side end of antenna conductor 2 (the place corresponding to a place of a middle of a left half part of AMC 7 (i.e., printed wiring board 1) and extends from the place toward a left edge of printed wiring board 1 to have a predetermined length in the positive z-direction. A site where opening 7*b* is formed includes a place being directly below and substantially facing the distal-side end of antenna conductor 3 (the place corresponding to a place of a middle of a right half part of AMC 7 (i.e., printed wiring board 1) and extends from the place toward a right edge of printed wiring board 1 to have a predetermined length in the negative z-direction.

Openings 7*c*, 7*d*, for example, extend toward distal ends of antenna device 101 in the longitudinal direction of antenna conductors 2, 3 from places (opening 7*c*, 7*d* are not present directly below the distal-side ends of antenna conductors 2, 3) that are separated from respective places substantially facing the distal-side ends opposite the feeder-side ends of antenna conductors 2, 3 toward the distal ends of antenna device 101 in the longitudinal direction of antenna conductors 2, 3.

Openings 7*a*, 7*b* are substantially identical in shape, and openings 7*c*, 7*d* are substantially identical in shape. Openings 7*a*, 7*c* and openings 7*b*, 7*d* are symmetric with respect to a center of AMC 7.

In FIG. 4, ground conductor 8 has via conductor insulating hole 18 that is formed so as to let via conductor 4 pass through and be electrically insulated from ground conductor 8, as well as a hole that is formed so as to let via conductor 5 pass through and be electrically connected with ground conductor 8. In FIG. 5, in a similar way to ground conductor 8, ground conductor 9 has via conductor insulating hole 19 that is formed so as to let via conductor 4 pass through and be electrically insulated from ground conductor 9, as well as a hole that is formed so as to let via conductor 5 pass through and be electrically connected with ground conductor 9.

In antenna device 101 according to the first exemplary embodiment, as is clear from FIGS. 2 to 5, AMC 7 and ground conductors 8, 9 have rectangular planar shapes that are substantially identical to one another and have a substantially congruent shape. AMC 7 and ground conductors 8, 9 face one another and are formed so as to be separated from and cover one another at predetermined intervals in the thickness direction. AMC 7 has openings 7*a* to 7*d* and slit 71 and is formed such that a length of AMC 7 in the longitudinal direction is substantially identical to a length of ground conductors 8, 9 in the longitudinal direction.

In comparison to antenna device 104 of FIG. 11 according to a comparative example, VSWR response of antenna device 101, which is configured as described above according to the first exemplary embodiment, over a frequency range will be described below.

Figure 11:
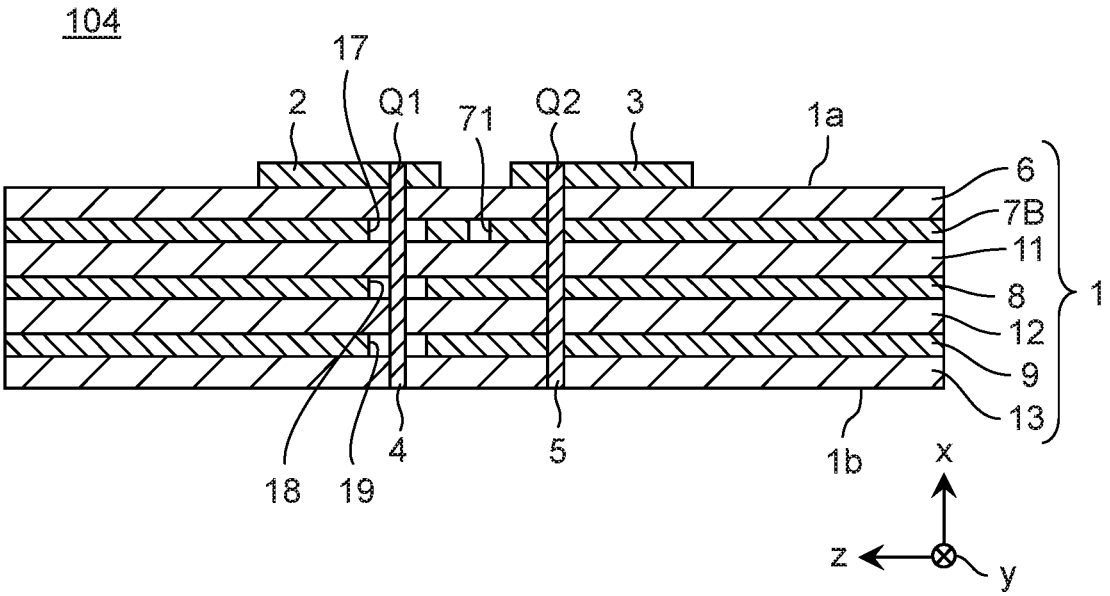
FIG. 11 is a longitudinal sectional view illustrating a configuration of antenna device 104 according to a comparative example.

FIG. 11 is a longitudinal sectional view illustrating a configuration of antenna device 104 according to the comparative example. In FIG. 11, as compared with antenna device 101 according to the first exemplary embodiment, antenna device 104 according to the comparative example does not have openings 7*a* to 7*d* in AMC 7B. In contrast to this, antenna device 101 according to the first exemplary embodiment includes AMC 7 that is put between two antenna conductors 2, 3 and two ground conductors 8, 9 and that is separated from antenna conductors 2, 3 and ground conductors 8, 9, wherein AMC 7 has at least openings 7*a*, 7*b* that are formed at places being directly below and facing the respective distal-side ends of antenna conductors 2, 3.

Figure 17:
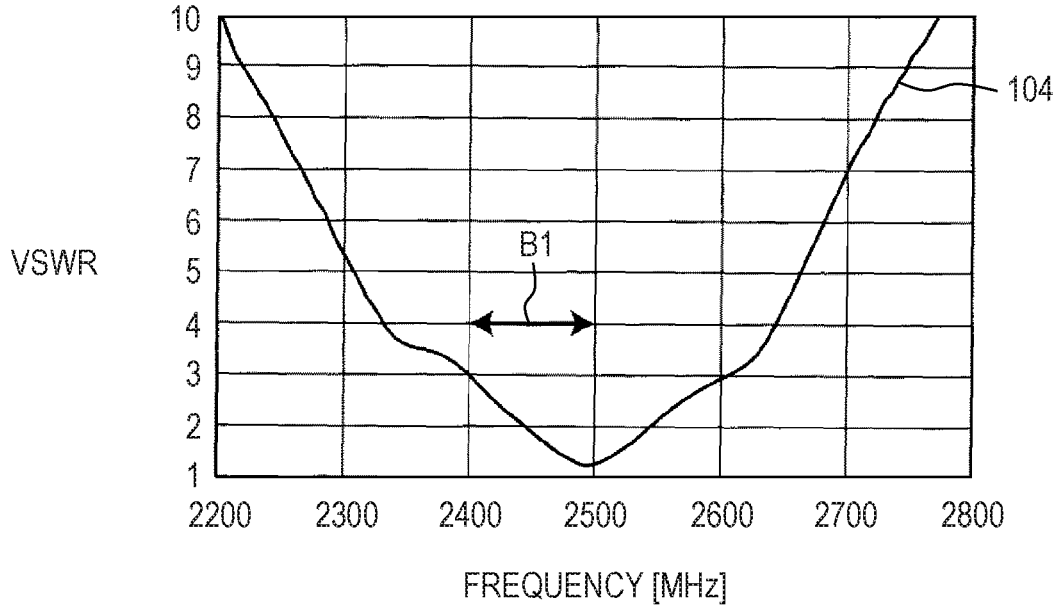
FIG. 17 is a graph illustrating a voltage standing wave ratio (hereinafter referred to as VSWR) versus frequency curve of antenna device 104 according to the comparative example over and around fundamental wave frequency band B1.
Figure 18:
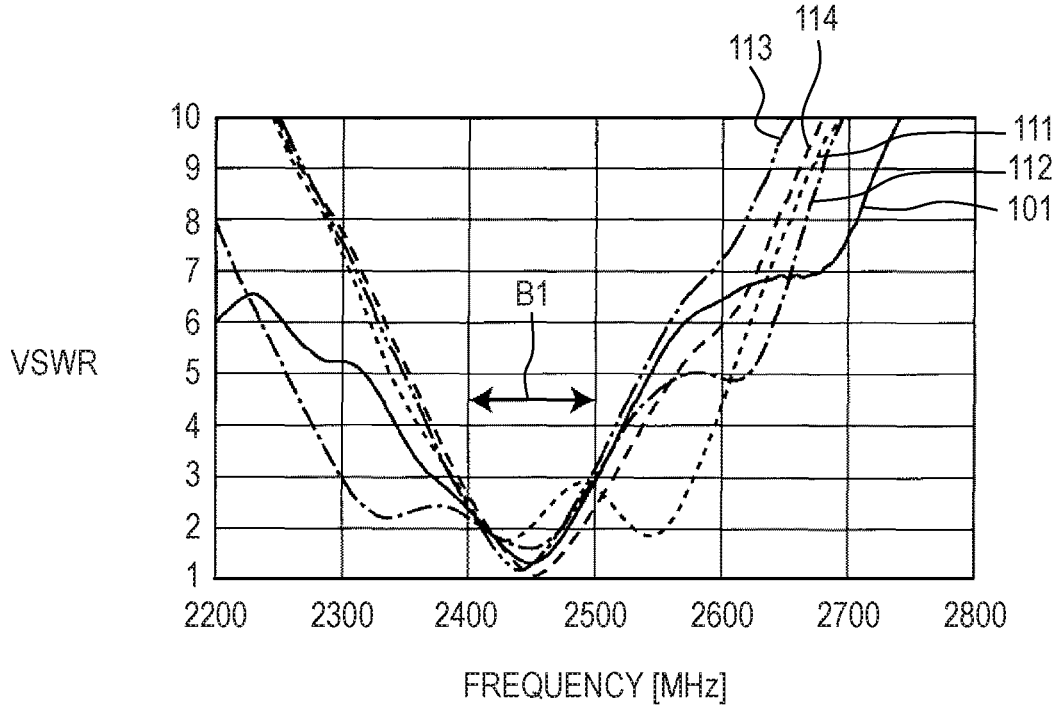
FIG. 18 is a graph illustrating VSWR versus frequency curves of antenna device 101 according to the first exemplary embodiment and antenna devices 111 to 114 of the first to the fourth modification examples over and around fundamental wave frequency band B1.

FIG. 17 is a graph illustrating a VSWR versus frequency curve of antenna device 104 according to the comparative example over and around fundamental wave frequency band B1, and FIG. 18 is a graph illustrating a VSWR versus frequency curve of antenna device 101 according to the first exemplary embodiment over and around fundamental wave frequency band B1. The graph of FIG. 18 includes curves of antenna devices 111 to 114 according to the first to the fourth modification examples described later. In the graphs of FIGS. 17 to 24 showing VSWR versus frequency curves, numerals attached to the curves denote those of antenna devices. As is clear from a comparison between FIGS. 17 and 18, VSWRs of antenna devices 101, 104 over fundamental wave frequency band B1 are less than or equal to 3, showing that antenna devices 101, 104 are capable of sending and receiving wireless signals in fundamental wave frequency band B1 with a loss less than or equal to a predetermined amount.

Figure 19:
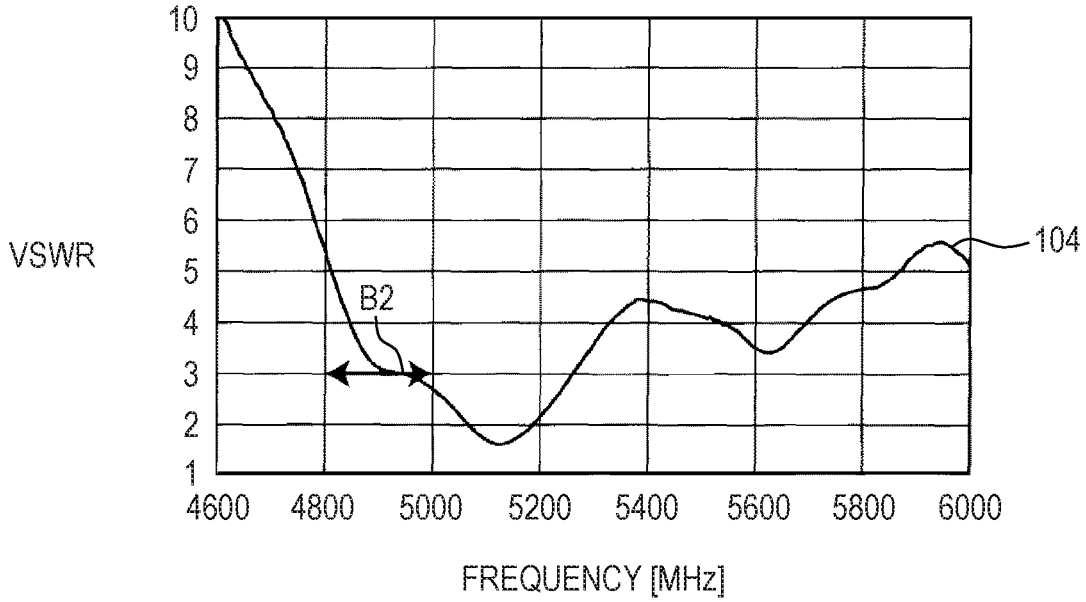
FIG. 19 is a graph illustrating a VSWR versus frequency curve of antenna device 104 according to the comparative example over and around second-order harmonic frequency band B2.
Figure 20:
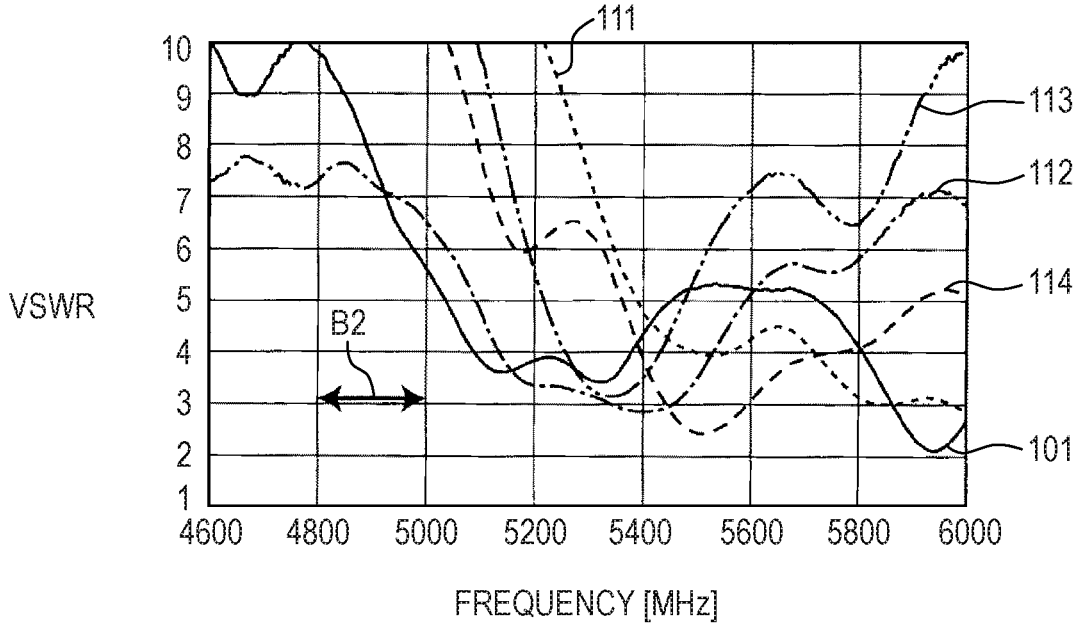
FIG. 20 is a graph illustrating VSWR versus frequency curves of antenna device 101 according to the first exemplary embodiment and antenna devices 111 to 114 of the first to the fourth modification examples over and around second-order harmonic frequency band B2.

FIG. 19 is a graph illustrating a VSWR versus frequency curve of antenna device 104 according to the comparative example over and around second-order harmonic frequency band B2, and FIG. 20 is a graph illustrating a VSWR versus frequency curve of antenna device 101 according to the first exemplary embodiment over and around second-order harmonic frequency band B2. The graph of FIG. 20 includes curves of antenna devices 111 to 114 according to the first to the fourth modification examples described later. As is clear from a comparison between FIGS. 19 and 20, whereas antenna device 104 leaks and emits wireless signals in second-order harmonic frequency band B2, the VSWR versus frequency curve of antenna device 101 shows an increasing VSWR trend in a relatively low frequency range and thus the VSWR of antenna device 101 is roughly greater than or equal to 6 over second-order harmonic frequency band B2. This shows that antenna device 101 is able to satisfactorily hinder the emission of wireless signals in second-order harmonic frequency band B2.

According to the first exemplary embodiment described above, because of at least openings 7*a*, 7*b* formed in AMC 7, the antenna device is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

In particular, according to the first exemplary embodiment, the site where opening 7*a* is formed extends from a place being directly below and substantially facing the distal-side end of antenna conductor 2 toward the left edge of printed wiring board 1 in the positive z-direction. The site where opening 7*b* is formed extends from a place being directly below and substantially facing the distal-side end of antenna conductor 3 toward the right edge of printed wiring board 1 in the negative z-direction. Thus, it is estimated that the antenna device is able to leak second-order harmonic components through openings 7*a*, 7*b* in the negative x-direction and reduce the emission of wireless signals in second-order harmonic frequency band B2 in the positive x-direction.

In the first exemplary embodiment, openings 7*a*, 7*b*, 7*c*, 7*d* are rectangular in shape. However, the scope of the present disclosure is not limited to this example. The openings may be shaped into other forms such as polygons, circles, or ellipses.

In the first exemplary embodiment, via conductor insulating holes 17, 18, 19 and the holes that are formed so as to let via conductor 5 pass through and be electrically connected with AMC 7 and ground conductors 8, 9 are circular in shape. However, the scope of the present disclosure is not limited to this example. The holes may be shaped into other forms such as ellipses or rectangles.

In antenna device 101 of the first exemplary embodiment, via conductor insulating holes 18, 19 are formed such that via conductor 4 is not electrically connected with ground conductors 8, 9. However, an antenna device may be configured without via conductor insulating holes 18, 19 such that via conductor 4 is electrically connected with ground conductors 8, 9 in the same way as via conductor 5.

In the first exemplary embodiment, openings 7*c*, 7*d* are formed. However, the openings may not be formed with proviso that the antenna device is able to hinder the emission of wireless signals in second-order harmonic frequency band B2.

Second Exemplary Embodiment

Figure 6:
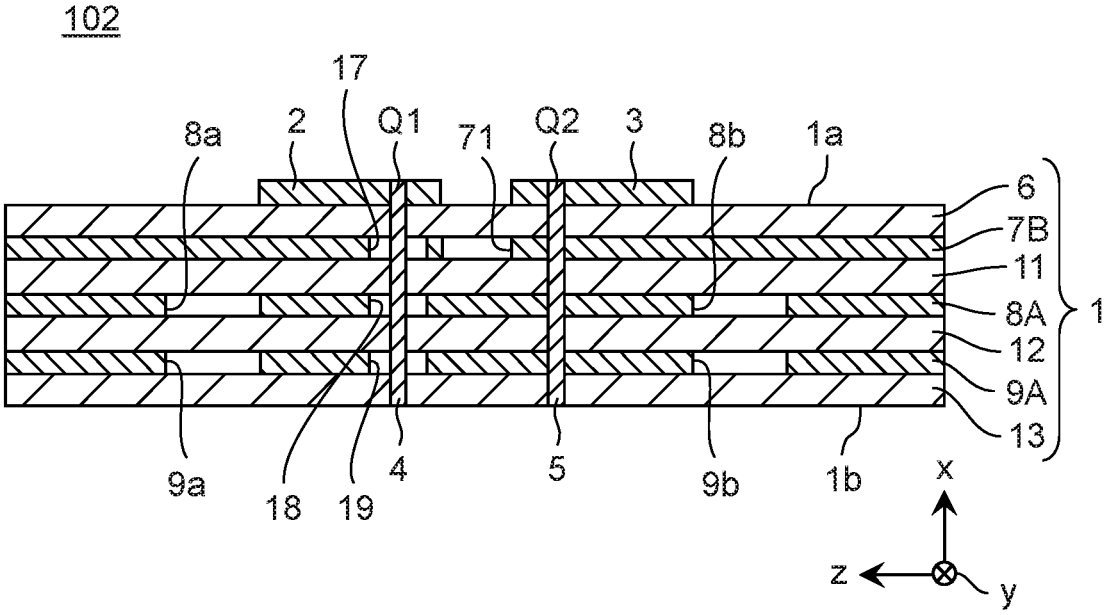
FIG. 6 is a longitudinal sectional view illustrating a configuration of antenna device 102 according to a second exemplary embodiment.
Figure 7:
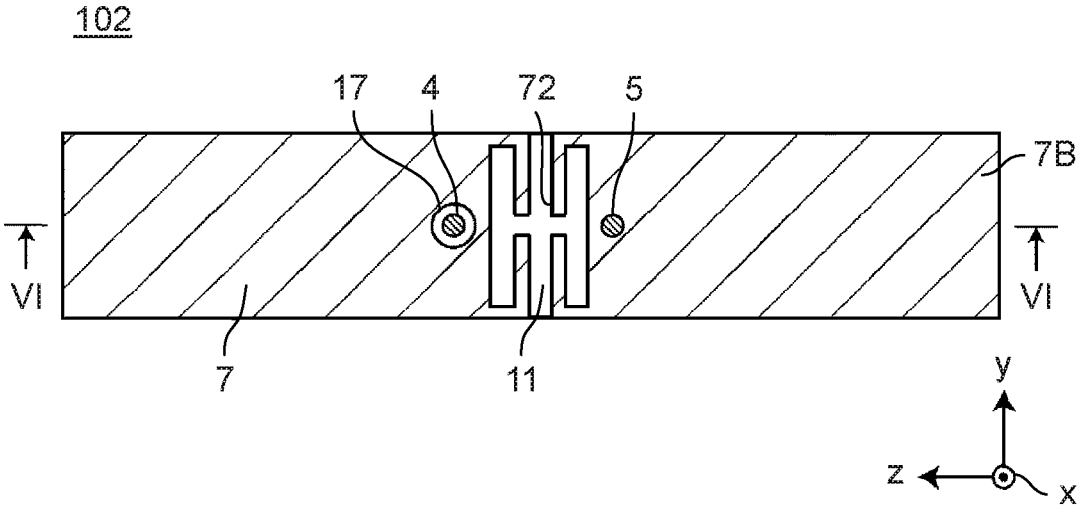
FIG. 7 is a plan view of antenna device 102 of FIG. 6, omitting layers upper than AMC 7B.
Figure 8:
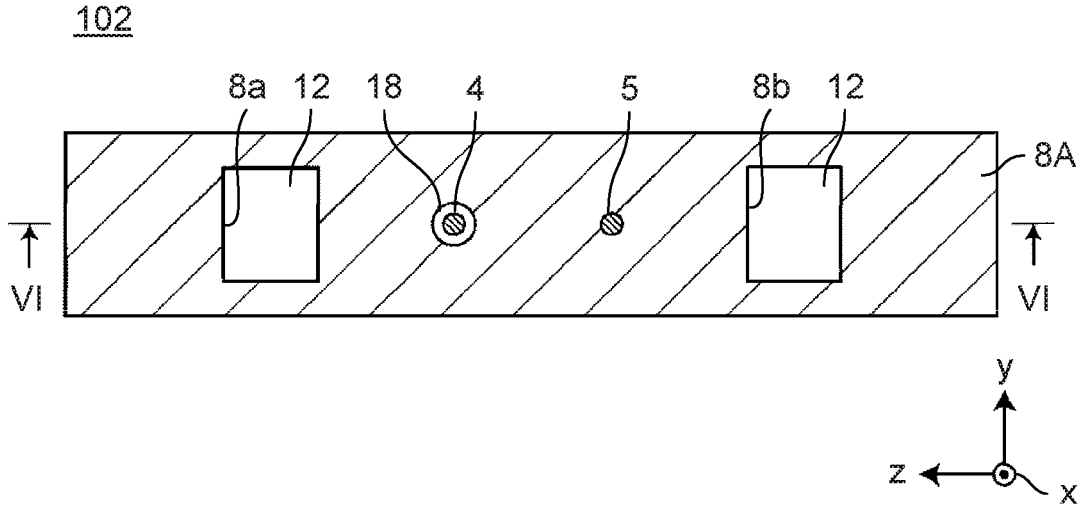
FIG. 8 is a plan view of antenna device 102 of FIG. 6, omitting layers upper than ground conductor 8A.
Figure 9:
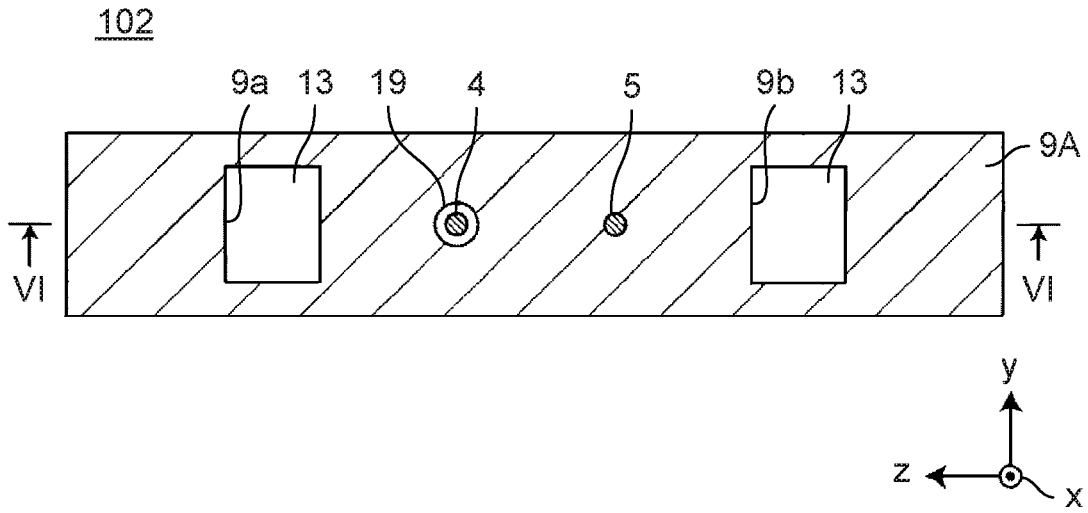
FIG. 9 is a plan view of antenna device 102 of FIG. 6, omitting layers upper than ground conductor 9A.

FIG. 6 is a longitudinal sectional view illustrating a configuration of antenna device 102 according to a second exemplary embodiment. FIG. 7 is a plan view of antenna device 102 of FIG. 6, omitting layers upper than AMC 7B. FIG. 8 is a plan view of antenna device 102 of FIG. 6, omitting layers upper than ground conductor 8A, and FIG. 9 is a plan view of antenna device 102 of FIG. 6, omitting layers upper than ground conductor 9A.

Antenna device 102 according to the second exemplary embodiment, as shown in FIGS. 6 to 9, differs from antenna device 101 according to the first exemplary embodiment shown in FIGS. 1 to 5 in slit formed in the AMC as well as points (1) to (4) described below. As shown in FIG. 7, slit 72 of antenna device 102 includes a slit portion having a shape identical to the shape of one slit 71 shown in FIG. 3 and a pair of slit portions disposed on both sides of the slit portion. The pair of the slit portions extend through a predetermined length in the width direction and do not reach both ends in the width direction. Slit 72 has a shape such that these slit portions are joined together at a middle in the width direction. The antenna devices are similar in configuration other than these points and thus a detailed description of similar elements is omitted.

(1) The antenna device includes AMC 7B that does not have openings 7*a* to 7*d* instead of AMC 7 that has openings 7*a* to 7*d*.

(2) The antenna device includes ground conductor 8A having rectangular openings 8*a*, 8*b* instead of ground conductor 8 having no such openings.

(3) The antenna device includes ground conductor 9A having rectangular openings 9*a*, 9*b* instead of ground conductor 9 having no such openings.

(4) Openings 9*a*, 9*b* are formed at sites that are face-to-face with and equivalent to respective sites for openings 8*a*, 8*b* when viewed along the thickness direction. In a similar way to opening 7*a* in the first exemplary embodiment, the sites where openings 8*a*, 9*a* are formed each extend from a place being directly below and substantially facing a distal-side end of antenna conductor 2 to have a predetermined width in the width direction and a predetermined length toward a left edge of printed wiring board 1 in the positive z-direction. In a similar way to opening 7*b* in the first exemplary embodiment, the sites where openings 8*b*, 9*b* are formed each extend from a place being directly below and substantially facing a distal-side end of antenna conductor 3 to have a predetermined width in the width direction and a predetermined length toward a right edge of printed wiring board 1 in the negative z-direction.

Openings 8*a*, 8*b*, 9*a*, 9*b* are substantially identical in shape. Openings 8*a*, 9*a* and openings 8*b*, 9*b* are symmetric with respect to respective centers of ground conductors 8A, 9A.

Even though ground conductors 8A, 9A of FIGS. 8 and 9 have openings 8*a*, 8*b*, 9*a*, 9*b*, longitudinal edges of ground conductors 8A, 9A (upper and lower sides of a predetermined width of the rectangular shapes in FIGS. 8 and 9) are formed so as to face and cover longitudinal edges of AMC 7B of FIG. 7 in a plan view. The same applies to the first and third exemplary embodiments and the first and the third and the sixth to the eighth modification examples described later.

Figure 21:
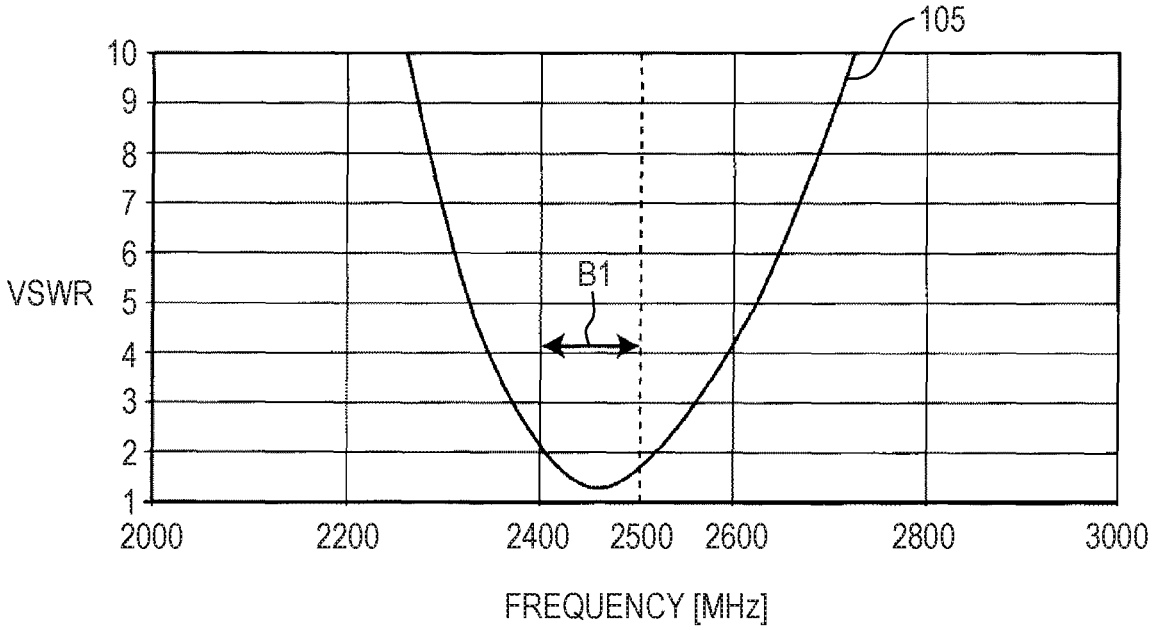
FIG. 21 is a graph illustrating a VSWR versus frequency curve of antenna device 105 according to a comparative example over and around fundamental wave frequency band B1.
Figure 22:
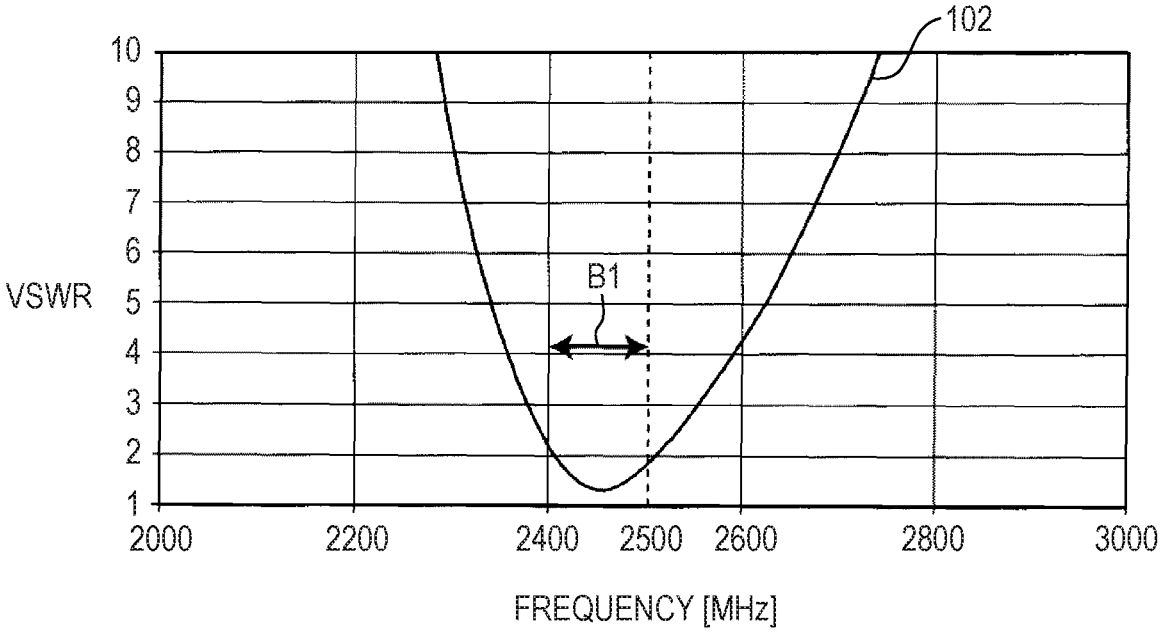
FIG. 22 is a graph illustrating a VSWR versus frequency curve of antenna device 102 according to the second exemplary embodiment over and around fundamental wave frequency band B1.

FIG. 21 is a graph illustrating a VSWR versus frequency curve of antenna device 105 according to a comparative example over and around fundamental wave frequency band B1. Antenna device 105 of the comparative example shares a configuration with antenna device 102 except that openings 8*a*, 8*b*, 9*a*, 9*b* are not formed in the ground conductors. FIG. 22 is a graph illustrating a VSWR versus frequency curve of antenna device 102 according to the second exemplary embodiment over and around fundamental wave frequency band B1. As is clear from a comparison between FIGS. 21 and 22, VSWRs of antenna devices 102, 105 over fundamental wave frequency band B1 are less than or equal to 3, showing that antenna devices 102, 105 are capable of sending and receiving wireless signals in fundamental wave frequency band B1 with a loss less than or equal to a predetermined amount.

Figure 23:
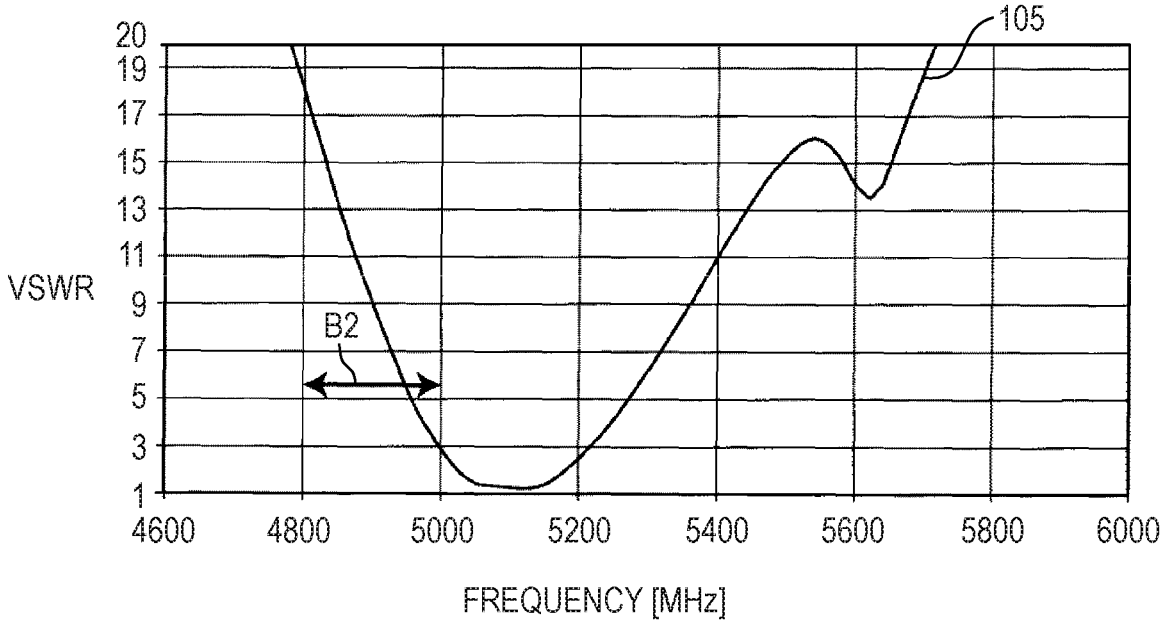
FIG. 23 is a graph illustrating a VSWR versus frequency curve of antenna device 105 according to the comparative example over and around second-order harmonic frequency band B2.
Figure 24:
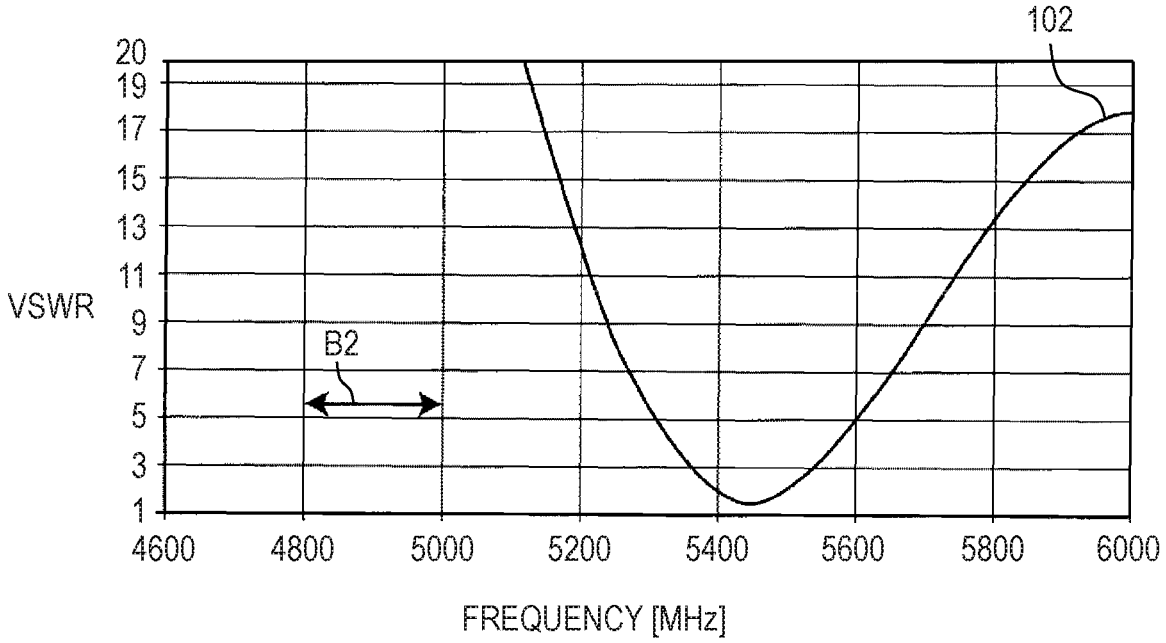
FIG. 24 is a graph illustrating a VSWR versus frequency curve of antenna device 102 according to the second exemplary embodiment over and around second-order harmonic frequency band B2.

FIG. 23 is a graph illustrating a VSWR versus frequency curve of antenna device 105 according to the comparative example over and around second-order harmonic frequency band B2, and FIG. 24 is a graph illustrating a VSWR versus frequency curve of antenna device 102 according to the second exemplary embodiment over and around second-order harmonic frequency band B2. As is clear from a comparison between FIGS. 23 and 24, whereas antenna device 105 leaks and emits wireless signals in second-order harmonic frequency band B2, the curve of antenna device 102 shows an increasing VSWR trend in a relatively low frequency range and thus the VSWR is greater than or equal to 20 over second-order harmonic frequency band B2. This shows that antenna device 102 is able to satisfactorily hinder the emission of wireless signals in second-order harmonic frequency band B2.

According to the second exemplary embodiment described above, because of openings 8*a*, 8*b* and openings 9*a*, 9*b* formed in ground conductors 8A, 9A, the antenna device is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

In particular, according to the second exemplary embodiment, the sites where openings 8*a*, 9*a* are formed extend from respective places on ground conductors 8A, 9A being directly below and substantially facing the distal-side end of antenna conductor 2 toward the left edge of printed wiring board 1 in the positive z-direction. The sites where openings 8*b*, 9*b* are formed extend from respective places on ground conductors 8A, 9A being directly below and substantially facing the distal-side end of antenna conductor 3 toward the right edge of printed wiring board 1 in the negative z-direction. Thus, it is estimated that the antenna device is able to leak second-order harmonic components through openings 8*a*, 8*b*, 9*a*, 9*b* in the negative x-direction and reduce the emission of wireless signals in second-order harmonic frequency band B2 in the positive x-direction.

In the second exemplary embodiment, openings 8*a*, 8*b*, 9*a*, 9*b* are rectangular in shape. However, the scope of the present disclosure is not limited to this example. The openings may be shaped into other forms such as polygons, circles, or ellipses.

In the second exemplary embodiment, via conductor insulating holes 17, 18, 19 and the holes that are formed so as to let via conductor 5 pass through and be electrically connected with AMC 7B and ground conductors 8A, 9A are circular in shape. However, the scope of the present disclosure is not limited to this example. The holes may be shaped into other forms such as ellipses or rectangles.

Third Exemplary Embodiment

Figure 10:
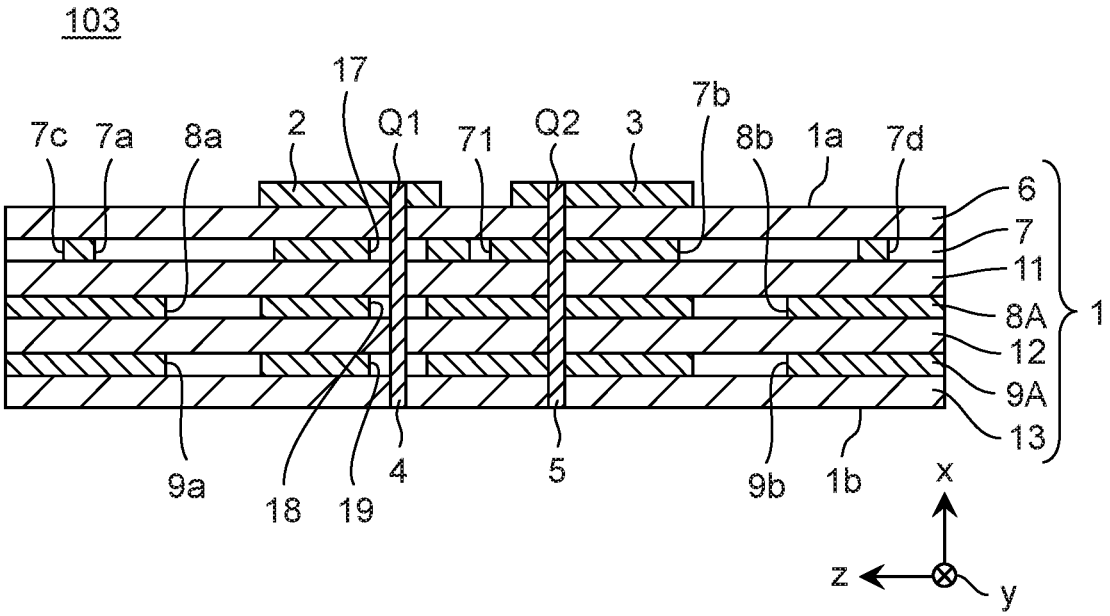
FIG. 10 is a longitudinal sectional view illustrating a configuration of antenna device 103 according to a third exemplary embodiment.

FIG. 10 is a longitudinal sectional view illustrating a configuration of antenna device 103 according to a third exemplary embodiment. Antenna device 103 according to the third exemplary embodiment, as shown in FIG. 10, differs from antenna device 101 according to the first exemplary embodiment shown in FIGS. 1 to 5 in points (1) and (2) described below. The antenna devices are similar in configuration other than these points and thus a detailed description of similar elements is omitted.

(1) The antenna device, in a similar way to the second exemplary embodiment, includes ground conductor 8A having rectangular openings 8*a*, 8*b* instead of ground conductor 8 having no such openings.

(2) The antenna device, in a similar way to the second exemplary embodiment, includes ground conductor 9A having rectangular openings 9*a*, 9*b* instead of ground conductor 9 having no such openings.

In other words, antenna device 103 according to the third exemplary embodiment includes (1) AMC 7 having openings 7*a* to 7*d*, (2) ground conductor 8A having openings 8*a*, 8*b*, and (3) ground conductor 9A having openings 9*a*, 9*b*.

In a similar way to the first and the second exemplary embodiments, the antenna device according to the third exemplary embodiment described above is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

Modification Examples of First to Third Exemplary Embodiments

First Modification Example

Figure 12:
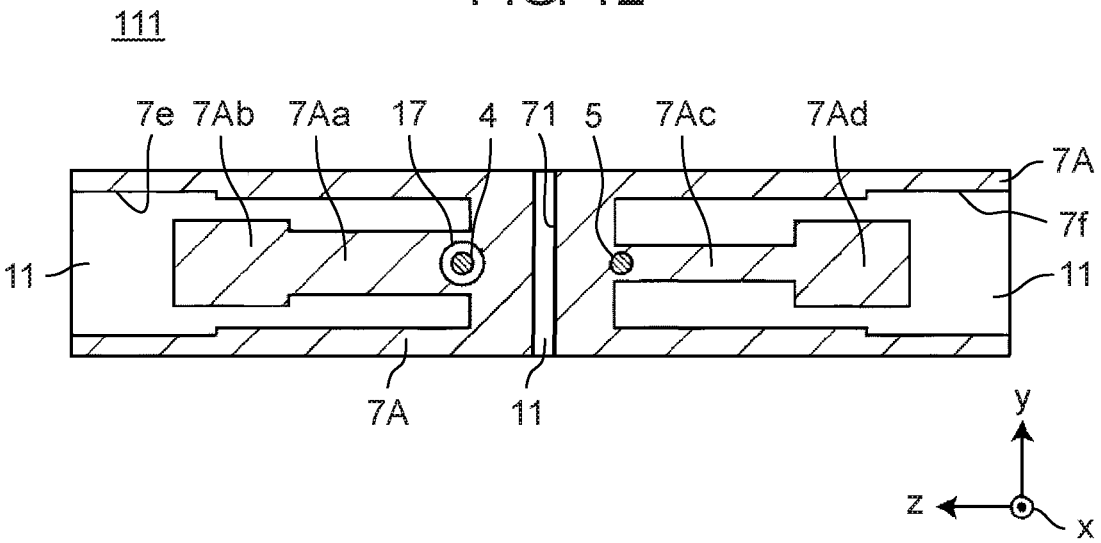
FIG. 12 is a plan view of antenna device 111 according to a first modification example, omitting layers upper than AMC 7A.

FIG. 12 is a plan view of antenna device 111 according to a first modification example, omitting layers upper than AMC 7A. Antenna device 111 according to the first modification example is based on antenna device 101 according to the first exemplary embodiment, wherein AMC 7 is replaced with AMC 7A of FIG. 12. In FIG. 12, AMC 7A includes (1) AMC part 7Aa of a small width part and AMC part 7Ab of a large width part that are formed so as to extend from a longitudinal and widthwise middle of AMC 7A in the positive z-direction, (2) AMC part 7Ac of a small width part and AMC part 7Ad of a large width part that are formed so as to extend from the longitudinal and widthwise middle of AMC 7A in the negative z-direction, (3) opening 7*e* that is formed instead of openings 7*a*, 7*c* in AMC 7 (see FIG. 3) so as to extend from near a position of via conductor 4 to a left edge of AMC 7A in the positive z-direction, and (4) opening 7*f* that is formed instead of openings 7*b*, 7*d* in AMC 7 (see FIG. 3) so as to extend from near a position of via conductor 5 to a right edge of AMC 7A in the negative z-direction.

Opening 7*e* has an opening portion that is divided into two in the width direction by AMC parts 7Aa, 7Ab, extending from near the position of via conductor 4 in the positive z-direction, and an opening portion that joins the divided opening portion at a distal end of AMC 7A in the positive z-direction. Similarly, opening 7*f* has an opening portion that is divided into two in the width direction by AMC parts 7Ac, 7Ad, extending from near the position of via conductor 5 in the negative z-direction, and an opening portion that joins the divided opening portion at a distal end of AMC 7A in the negative z-direction. The opening portions of openings 7*e*, 7*f* divided by the AMC parts each extend through a predetermined length in the longitudinal direction. In this way, AMC 7A includes the opening portions divided in the width direction at places substantially facing the respective distal-side ends of antenna conductors 2, 3.

AMC part 7Ab and AMC part 7Ad of the large width parts are substantially identical in shape and are symmetric with respect to a center of AMC 7A. AMC part 7Aa of the small width part is substantially equal in length in the longitudinal direction to AMC part 7Ac and is greater in width in the width direction than AMC part 7Ac. AMC part 7Ab of the large width part and ground conductor 8 form first capacitance therebetween, and AMC part 7Ad of the large width part and ground conductor 8 form second capacitance therebetween.

FIG. 17 is a graph illustrating a VSWR versus frequency curve of antenna device 104 according to the comparative example over and around fundamental wave frequency band B1, and FIG. 18 is a graph illustrating a VSWR versus frequency curve of antenna device 111 according to the first modification example over and around fundamental wave frequency band B1. As is clear from a comparison between FIGS. 17 and 18, VSWRs of antenna devices 111, 104 over fundamental wave frequency band B1 are less than or equal to 3, showing that antenna devices 111, 104 are capable of sending and receiving wireless signals in fundamental wave frequency band B1 with a loss less than or equal to a predetermined amount.

FIG. 19 is a graph illustrating a VSWR versus frequency curve of antenna device 104 according to the comparative example over and around second-order harmonic frequency band B2, and FIG. 20 is a graph illustrating a VSWR versus frequency curve of antenna device 111 according to the first modification example over and around second-order harmonic frequency band B2. As is clear from a comparison between FIGS. 19 and 20, whereas antenna device 104 leaks and emits wireless signals in second-order harmonic frequency band B2, the curve of antenna device 111 shows an increasing VSWR trend in a relatively low frequency range and thus the VSWR is greater than or equal to 10 over second-order harmonic frequency band B2. This shows that antenna device 111 is able to satisfactorily hinder the emission of wireless signals in second-order harmonic frequency band B2.

According to the first modification example described above, because of openings 7*e*, 7*f* and others formed in AMC 7A, the antenna device is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

The antenna device in the first modification example includes ground conductors 8, 9. Instead of these components, this example of the present disclosure may include ground conductor 8A of FIG. 8 and ground conductor 9A of FIG. 9 described in the second exemplary embodiment.

Second Modification Example

Figure 13:
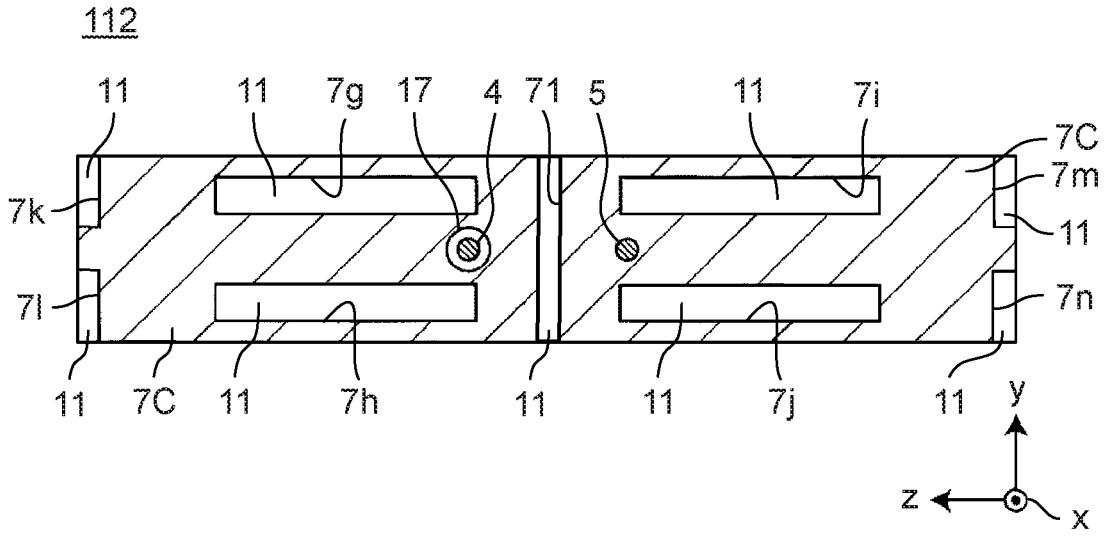
FIG. 13 is a plan view of antenna device 112 according to a second modification example, omitting layers upper than AMC 7C.

FIG. 13 is a plan view of antenna device 112 according to a second modification example, omitting layers upper than AMC 7C. Antenna device 112 according to the second modification example is based on antenna device 101 according to the first exemplary embodiment, wherein AMC 7 is replaced with AMC 7C of FIG. 13. In FIG. 13, AMC 7C includes (1) two rectangular openings 7*g*, 7*h* that correspond to opening 7*a* (see FIG. 3) in AMC 7 and that are formed parallel to each other so as to extend from near a position of via conductor 4 to have a predetermined width as well as a predetermined length in the positive z-direction, (2) two rectangular openings 7*i*, 7*j* that correspond to opening 7*b* (see FIG. 3) in AMC 7 and that are formed parallel to each other so as to extend from near a position of via conductor 5 to have a predetermined width as well as a predetermined length in the negative z-direction, (3) two rectangular openings 7*k*, 7*l* that correspond to opening 7*c* (see FIG. 3) in AMC 7 and that are formed at an upper left corner and a lower left corner of printed wiring board 1 respectively, and (4) two rectangular openings 7*m*, 7*n* that correspond to opening 7*d* (see FIG. 3) in AMC 7 and that are formed at an upper right corner and a lower right corner of printed wiring board 1 respectively.

As shown in FIG. 13, opening 7*g* and opening 7*h*, opening 7*i* and opening 7*j*, opening 7*k* and opening 7*l*, and opening 7*m* and opening 7*n* are arranged side by side with respective AMC parts of AMC 7C put between the opposing openings in the width direction. Thus, AMC 7C has two openings 7*g*, 7*h* at a place substantially facing a distal-side end of antenna conductor 2 such that an AMC part of AMC 7C is put between the openings in the width direction. Similarly, AMC 7C has two openings 7*i*, 7*j* at a place substantially facing a distal-side end of antenna conductor 3 such that an AMC part of AMC 7C is put between the openings in the width direction. Opening 7*g* and opening 7*h*, opening 7*i* and opening 7*j*, opening 7*k* and opening 7*l*, and opening 7*m* and opening 7*n* each have respective shapes that are substantially symmetrical in the width direction. Opening 7*g* and opening 7*i*, opening 7*h* and opening 7*j*, opening 7*k* and opening 7*m*, and opening 7*l* and opening 7*n* each have respective shapes that are substantially symmetrical in the longitudinal direction.

FIG. 17 is a graph illustrating a VSWR versus frequency curve of antenna device 104 according to the comparative example over and around fundamental wave frequency band B1, and FIG. 18 is a graph illustrating a VSWR versus frequency curve of antenna device 112 according to the second modification example over and around fundamental wave frequency band B1. As is clear from a comparison between FIGS. 17 and 18, VSWRs of antenna devices 112, 104 over fundamental wave frequency band B1 are less than or equal to 3, showing that antenna devices 112, 104 are capable of sending and receiving wireless signals in fundamental wave frequency band B1 with a loss less than or equal to a predetermined amount.

FIG. 19 is a graph illustrating a VSWR versus frequency curve of antenna device 104 according to the comparative example over and around second-order harmonic frequency band B2, and FIG. 20 is a graph illustrating a VSWR versus frequency curve of antenna device 112 according to the second modification example over and around second-order harmonic frequency band B2. As is clear from a comparison between FIGS. 19 and 20, whereas antenna device 104 leaks and emits wireless signals in second-order harmonic frequency band B2, the curve of antenna device 112 shows an increasing VSWR trend in a relatively low frequency range and thus the VSWR is greater than or equal to 10 over second-order harmonic frequency band B2. This shows that antenna device 112 is able to satisfactorily hinder the emission of wireless signals in second-order harmonic frequency band B2.

According to the second modification example described above, because of openings 7*g*, 7*h*, 7*i*, 7*j*, 7*k*, 7*l*, 7*m*, 7*n* and others formed in AMC 7C, the antenna device is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

The antenna device in the second modification example includes ground conductors 8, 9. Instead of these components, this example of the present disclosure may include ground conductor 8A of FIG. 8 and ground conductor 9A of FIG. 9 described in the second exemplary embodiment.

Third Modification Example

Figure 14:
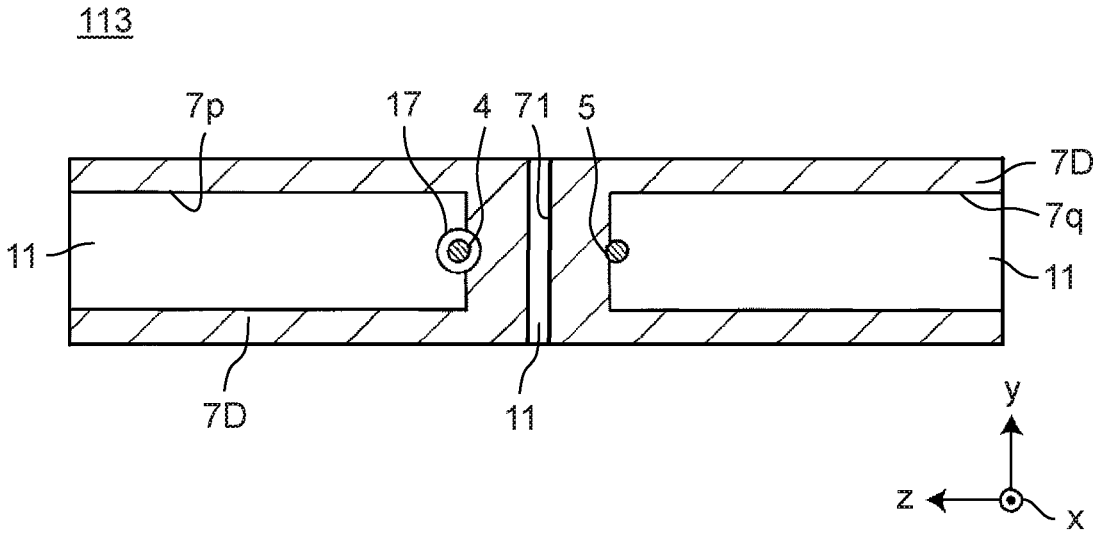
FIG. 14 is a plan view of antenna device 113 according to a third modification example, omitting layers upper than AMC 7D.

FIG. 14 is a plan view of antenna device 113 according to a third modification example, omitting layers upper than AMC 7D. Antenna device 113 according to the third modification example is based on antenna device 101 according to the first exemplary embodiment, wherein AMC 7 is replaced with AMC 7D of FIG. 14. In FIG. 14, AMC 7D includes (1) opening 7*p* that corresponds to openings 7*a*, 7*c* (see FIG. 3) in AMC 7 and that is formed so as to extend from near a position of via conductor 4 to a left edge of AMC 7D in the positive z-direction, and (2) opening 7*q* that corresponds to openings 7*b*, 7*d* (see FIG. 3) in AMC 7 and that is formed so as to extend from near a position of via conductor 5 (conductor 5 and AMC 7D are connected together) to a right edge of AMC 7D in the negative z-direction.

AMC 7D includes openings 7*p*, 7*q* and hence has openings at places substantially facing respective distal-side ends of antenna conductors 2, 3. Opening 7*p* and opening 7*q* have respective shapes that are substantially symmetrical in the longitudinal direction.

FIG. 17 is a graph illustrating a VSWR versus frequency curve of antenna device 104 according to the comparative example over and around fundamental wave frequency band B1, and FIG. 18 is a graph illustrating a VSWR versus frequency curve of antenna device 113 according to the third modification example over and around fundamental wave frequency band B1. As is clear from a comparison between FIGS. 17 and 18, VSWRs of antenna devices 113, 104 over fundamental wave frequency band B1 are less than or equal to 3, showing that antenna devices 113, 104 are capable of sending and receiving wireless signals in fundamental wave frequency band B1 with a loss less than or equal to a predetermined amount.

FIG. 19 is a graph illustrating a VSWR versus frequency curve of antenna device 104 according to the comparative example over and around second-order harmonic frequency band B2, and FIG. 20 is a graph illustrating a VSWR versus frequency curve of antenna device 113 according to the third modification example over and around second-order harmonic frequency band B2. As is clear from a comparison between FIGS. 19 and 20, whereas antenna device 104 leaks and emits wireless signals in second-order harmonic frequency band B2, the curve of antenna device 113 shows an increasing VSWR trend in a relatively low frequency range and thus the VSWR is greater than or equal to 10 over second-order harmonic frequency band B2. This shows that antenna device 113 is able to satisfactorily hinder the emission of wireless signals in second-order harmonic frequency band B2.

According to the third modification example described above, because of openings 7*p*, 7*q* formed in AMC 7D, the antenna device is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

The antenna device in the third modification example includes ground conductors 8, 9. Instead of these components, this example of the present disclosure may include ground conductor 8A of FIG. 8 and ground conductor 9A of FIG. 9 described in the second exemplary embodiment.

Fourth Modification Example

Figure 15:
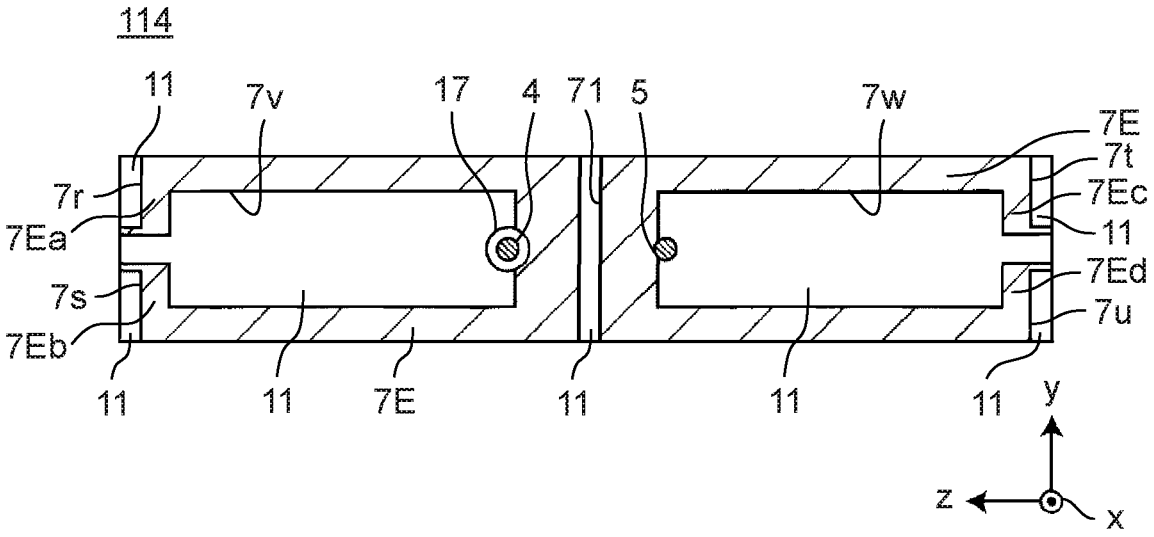
FIG. 15 is a plan view of antenna device 114 according to a fourth modification example, omitting layers upper than AMC 7E.

FIG. 15 is a plan view of antenna device 114 according to a fourth modification example, omitting layers upper than AMC 7E. Antenna device 114 according to the fourth modification example is based on antenna device 101 according to the first exemplary embodiment, wherein AMC 7 is replaced with AMC 7E of FIG. 15. In FIG. 15, as compared with AMC 7D of FIG. 14, AMC 7E has openings 7*v*, 7*w* corresponding to openings 7*p*, 7*q* and includes (1) AMC part 7Ea of an L-shaped part formed at an upper left corner of AMC 7E, (2) AMC part 7Eb of an L-shaped part formed at a lower left corner of AMC 7E, (3) AMC part 7Ec of an L-shaped part formed at an upper right corner of AMC 7E, (4) AMC part 7Ed of an L-shaped part formed at a lower right corner of AMC 7E, (5) rectangular opening 7*r* formed in the upper left corner of AMC 7E, (6) rectangular opening 7*s* formed in the lower left corner of AMC 7E, (7) rectangular opening 7*t* formed in the upper right corner of AMC 7E, and (8) rectangular opening 7*u* formed in the lower right corner of AMC 7E.

As shown in FIG. 15, openings 7*v*, 7*w* each have a large width part having a predetermined width and extending through a predetermined length toward a distal end of the AMC in the longitudinal direction and a small width part extending from the large width part and reaching the distal end in the longitudinal direction. AMC 7E includes openings 7*v*, 7*w* and hence has openings at places substantially facing respective distal-side ends of antenna conductors 2, 3. The small width part of opening 7*v* is disposed between openings 7*r*, 7*s* in the width direction, and the small width part of opening 7*w* is disposed between openings 7*t*, 7*u* in the width direction. Opening 7*v* and opening 7*w* have respective shapes that are substantially symmetrical in the longitudinal direction. Openings 7*r*, 7*s*, 7*t*, 7*u* are substantially identical to openings 7*k*, 7*l*, 7*m*, 7*n* of the second modification example shown in FIG. 13.

In the fourth modification example, AMC 7E has L-shaped AMC parts 7Ea to 7Ed and thus has a long resonant wavelength as compared with AMC 7D.

FIG. 17 is a graph illustrating a VSWR versus frequency curve of antenna device 104 according to the comparative example over and around fundamental wave frequency band B1, and FIG. 18 is a graph illustrating a VSWR versus frequency curve of antenna device 114 according to the fourth modification example over and around fundamental wave frequency band B1. As is clear from a comparison between FIGS. 17 and 18, VSWRs of antenna devices 114, 104 over fundamental wave frequency band B1 are less than or equal to 3, showing that antenna devices 114, 104 are capable of sending and receiving wireless signals in fundamental wave frequency band B1 with a loss less than or equal to a predetermined amount.

FIG. 19 is a graph illustrating a VSWR versus frequency curve of antenna device 104 according to the comparative example over and around second-order harmonic frequency band B2, and FIG. 20 is a graph illustrating a VSWR versus frequency curve of antenna device 114 according to the fourth modification example over and around second-order harmonic frequency band B2. As is clear from a comparison between FIGS. 19 and 20, whereas antenna device 104 leaks and emits wireless signals in second-order harmonic frequency band B2, the curve of antenna device 114 shows an increasing VSWR trend in a relatively low frequency range and thus the VSWR is greater than or equal to 10 over second-order harmonic frequency band B2. This shows that antenna device 114 is able to satisfactorily hinder the emission of wireless signals in second-order harmonic frequency band B2.

According to the fourth modification example described above, because of openings 7*r*, 7*s*, 7*t*, 7*u*, 7*v*, 7*w* formed in AMC 7E, the antenna device is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

The antenna device in the fourth modification example includes ground conductors 8, 9. Instead of these components, this example of the present disclosure may include ground conductor 8A of FIG. 8 and ground conductor 9A of FIG. 9.

Fifth Modification Example

Figure 16:
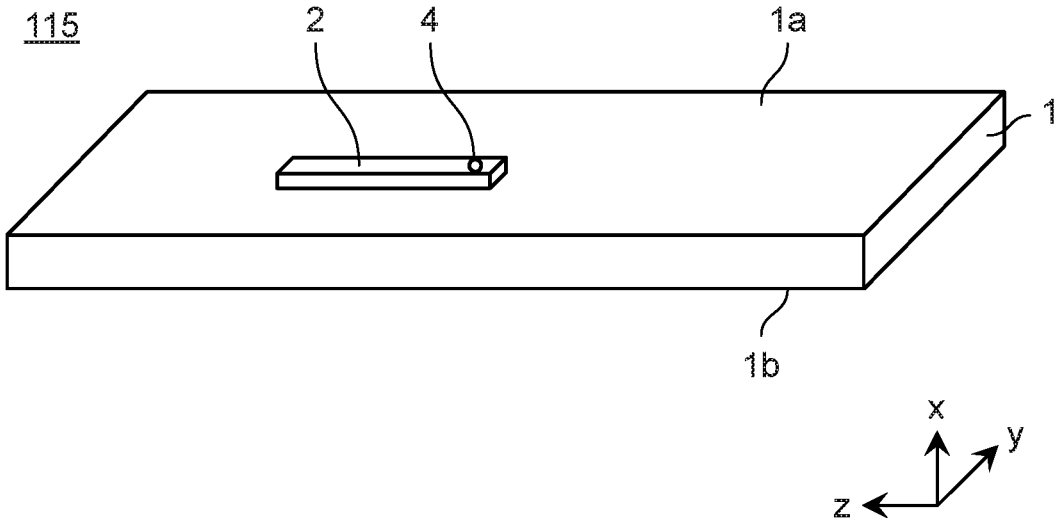
FIG. 16 is an external perspective view illustrating antenna device 115 according to a fifth modification example.

FIG. 16 is an external perspective view illustrating antenna device 115 according to a fifth modification example. As compared with antenna device 101 according to the first exemplary embodiment in FIG. 1, antenna device 115 according to the fifth modification example includes just one antenna conductor 2 instead of two antenna conductors 2, 3 and hence constitutes a monopole antenna. As compared with antenna device 101 according to the first exemplary embodiment, antenna device 115 according to the fifth modification example has similar effects except for a change in emission characteristic.

Antenna devices 102, 103, 111 to 114 of the second and the third exemplary embodiments and the first to the fourth modification examples may each constitute a monopole antenna in the same way as the fifth modification example of FIG. 16.

Sixth Modification Example

Figure 25:
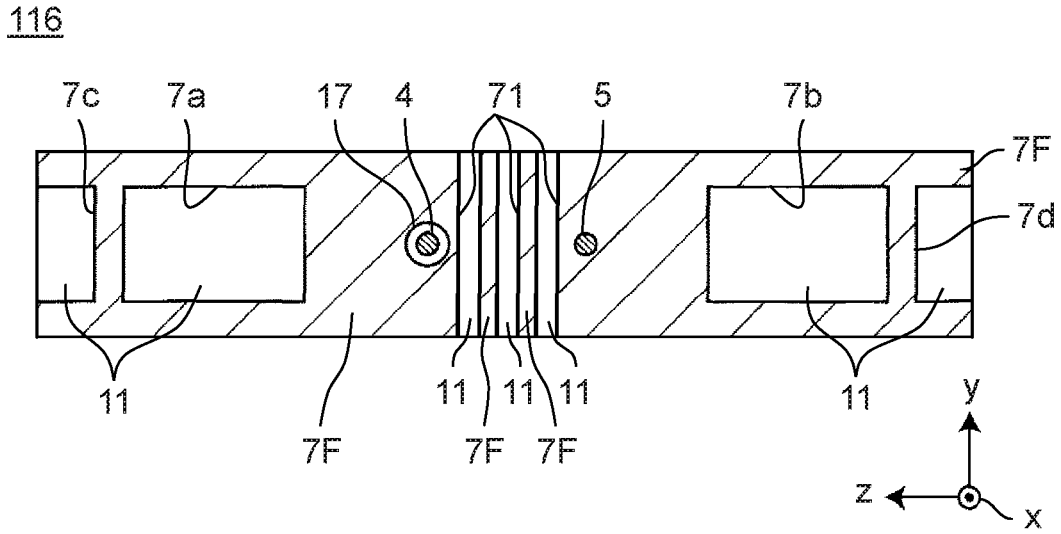
FIG. 25 is a drawing illustrating a configuration of AMC 7F according to a sixth modification example.

FIG. 25 is a plan view of antenna device 116 according to a sixth modification example, omitting layers upper than AMC 7F. As shown in FIG. 25, antenna device 116 according to the sixth modification example has three slits 71 in a layer of AMC 7F and hence differs from antenna device 101 of the first exemplary embodiment having one slit 71 in the layer of AMC 7. The remaining parts of antenna device 116 are similar to those of antenna device 101. Antenna device 116 according to the sixth modification example has effects similar to those of antenna device 101 according to the first exemplary embodiment.

One slit in each of the AMC layers of the antenna devices according to the second and the third exemplary embodiments and the first to the fifth modification examples may be replaced with three slits 71 as in the sixth modification example shown in FIG. 25.

Seventh Modification Example

Figure 26:
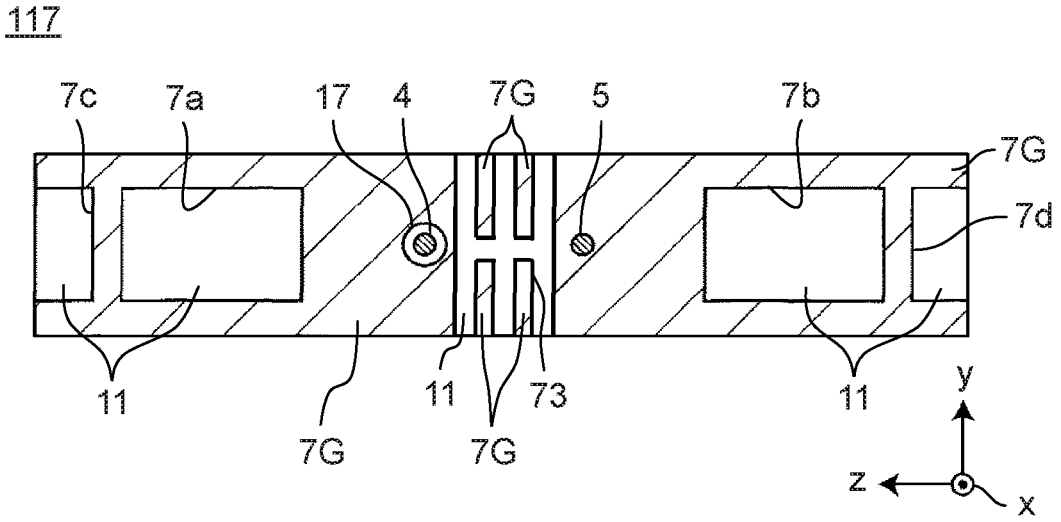
FIG. 26 is a drawing illustrating a configuration of AMC 7G according to a seventh modification example.

FIG. 26 is a plan view of antenna device 117 according to a seventh modification example, omitting layers upper than AMC 7G. Antenna device 117 according to the seventh modification example has slit 73 in a layer of AMC 7G and hence differs from antenna device 101 of the first exemplary embodiment having slit 71 in the layer of AMC 7. The remaining parts of antenna device 117 are similar to those of antenna device 101. As shown in FIG. 26, slit 73 has a shape such that three slits 71 shown in FIG. 25 are joined together at a middle in the width direction. Antenna device 117 according to the seventh modification example has effects similar to those of antenna device 101 according to the first exemplary embodiment.

The slit in each of the AMC layers of the antenna devices according to the second and the third exemplary embodiments and the first to the fifth modification examples may be replaced with slit 73 in the seventh modification example shown in FIG. 26.

Eighth Modification Example

Figure 27:
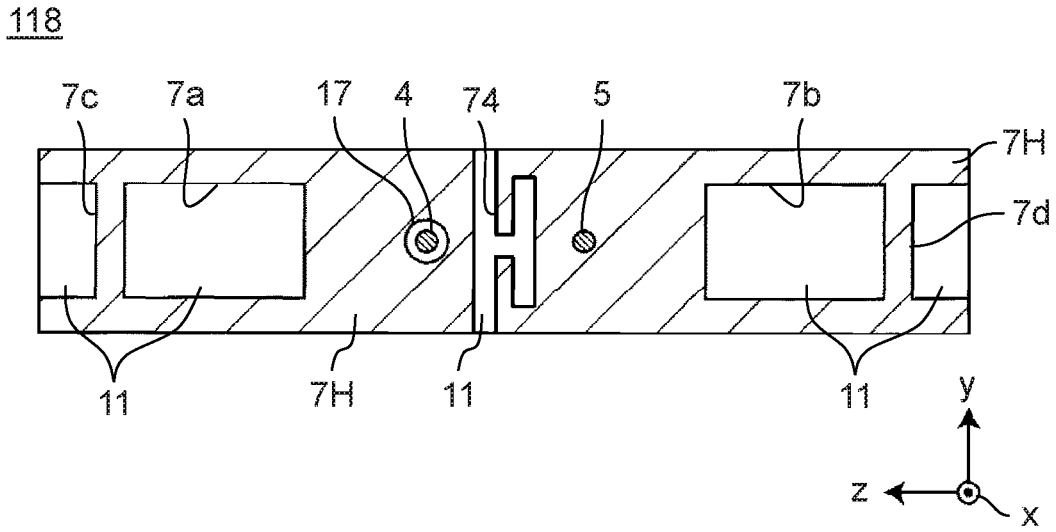
FIG. 27 is a drawing illustrating a configuration of AMC 7H according to an eighth modification example.

FIG. 27 is a plan view of antenna device 118 according to an eighth modification example, omitting layers upper than AMC 7H. Antenna device 118 according to the eighth modification example has slit 74 in a layer of AMC 7H and hence differs from antenna device 101 of the first exemplary embodiment having slit 71 in the layer of AMC 7. The remaining parts of antenna device 118 are similar to those of antenna device 101. As shown in FIG. 27, slit 74 has a shape such that one slit 71 shown in FIG. 3 and a slit extending through a predetermined length in the width direction and not reaching both ends in the width direction are joined together at a middle in the width direction. Antenna device 118 according to the eighth modification example has effects similar to those of antenna device 101 according to the first exemplary embodiment.

The slit in each of the AMC layers of the antenna devices according to the second and the third exemplary embodiments and the first to the fifth modification examples may be replaced with slit 74 in the eighth modification example shown in FIG. 27.

Fourth Exemplary Embodiment

Figure 28:
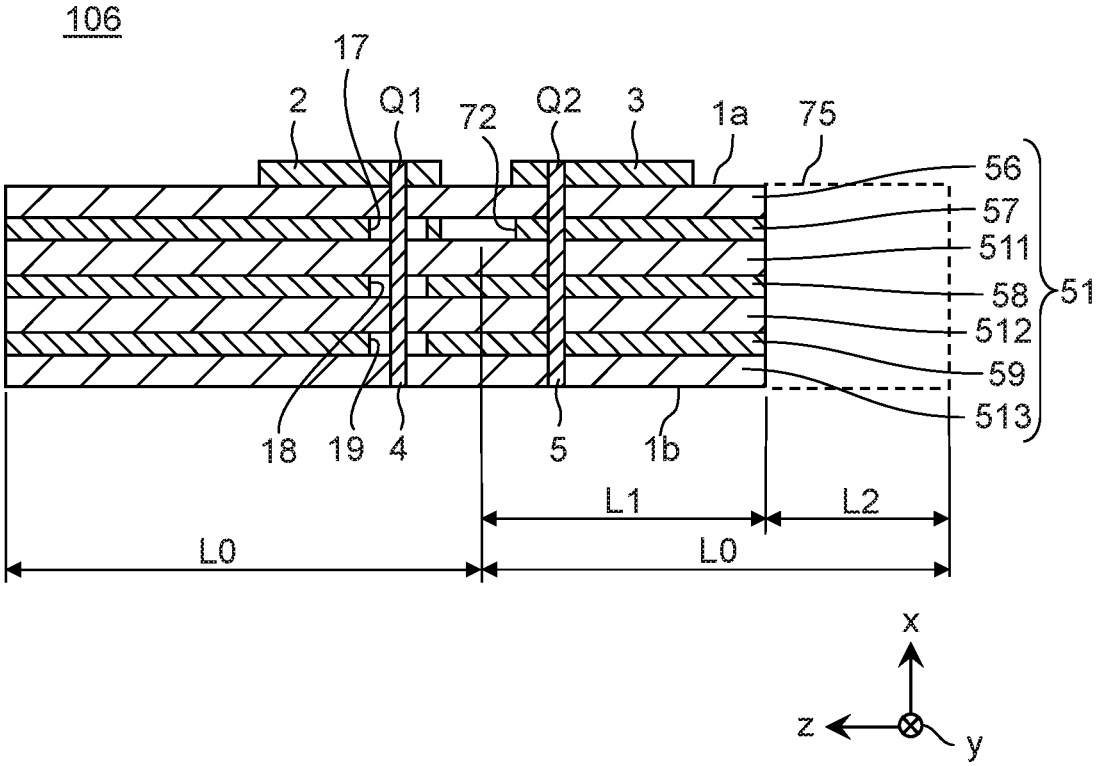
FIG. 28 is a longitudinal sectional view illustrating a configuration of antenna device 106 according to a fourth exemplary embodiment.

FIG. 28 is a longitudinal sectional view illustrating a configuration of antenna device 106 according to a fourth exemplary embodiment. As shown in FIG. 28, antenna device 106 has printed wiring board 51 instead of printed wiring board 1 of antenna device 101 described in the first exemplary embodiment. Printed wiring board 51 includes dielectric substrate 56, AMC 57, dielectric substrate 511, ground conductor 58, dielectric substrate 512, ground conductor 59, and dielectric substrate 513 that are stacked instead of dielectric substrate 6, AMC 7, dielectric substrate 11, ground conductor 8, dielectric substrate 12, ground conductor 9, and dielectric substrate 13 of printed wiring board 1. Other structural elements are identical to those in the first exemplary embodiment and thus are assigned with the same reference numerals and descriptions thereof are omitted.

Portions of antenna device 101 of the first exemplary embodiment extending from a middle of slit 71 in the positive z-direction (a side of antenna conductor 2) and in the negative z-direction (a side of antenna conductor 3) respectively are substantially equal in length. In antenna device 106 of the fourth exemplary embodiment, length L1 of a portion extending from a middle of slit 72 in the negative z-direction is shorter than length L0 of a portion extending in the positive z-direction by length L2 (=L0−L1). In other words, as shown in FIG. 28, antenna device 106 has a shape such that a part (cut part 75) at a distal end on a side of antenna conductor 3 is cut. To put it another way, antenna device 106 includes cut part 75, a part where none of the AMC and the ground conductors is formed, instead of openings such as openings 7*a* to 7*d*, 8*a*, 8*b*, 9*a*, 9*b* included in antenna devices 101 to 103 of the first to the third exemplary embodiments. A size of cut part 75 is represented by a ratio (a cut ratio=L2/L0) between length L0 of the portion of printed wiring board 51 extending from the middle of slit 72 to a distal end on the side of antenna conductor 2 (on a left side) and length L2 of cut part 75 (i.e., a difference between length L0 and length L1 of the portion of printed wiring board 51 extending to the distal end on the side of antenna conductor 3 (on a right side)). Slit 72 of antenna device 106 is similar in shape to slit 72 of antenna device 102 described in the second exemplary embodiment.

Figure 29:
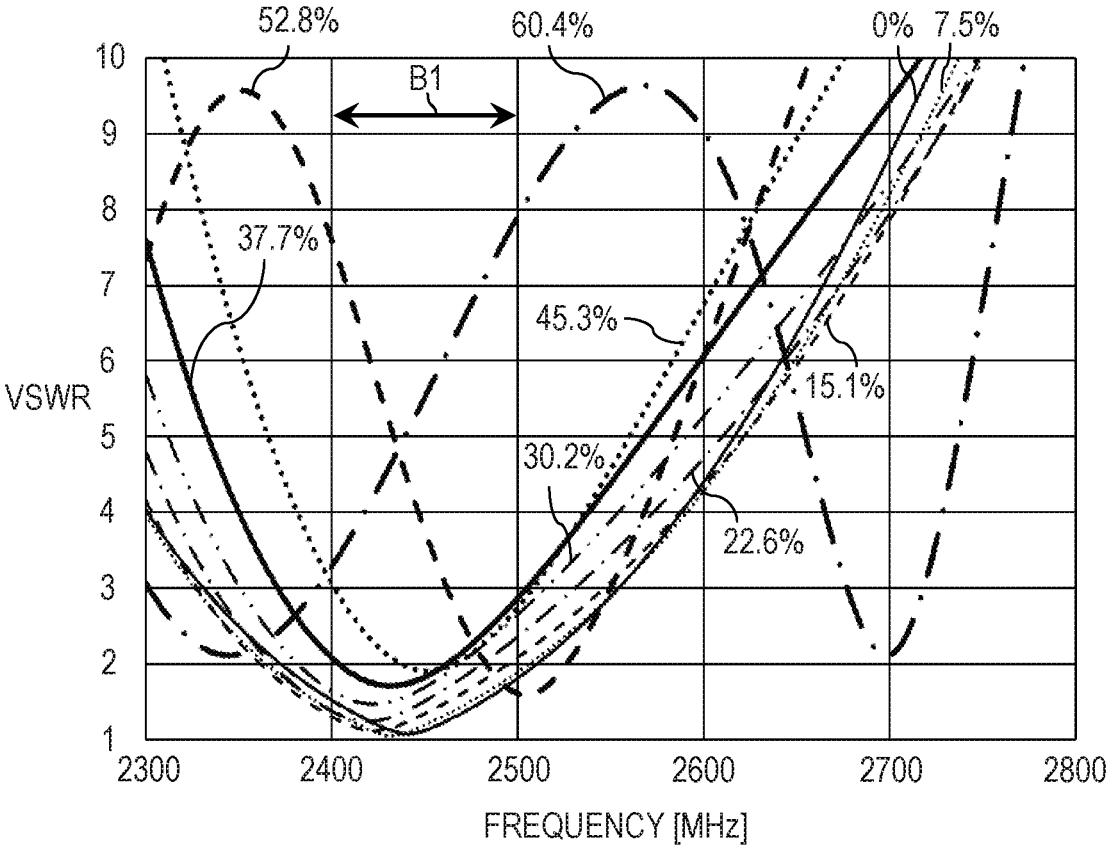
FIG. 29 is a graph illustrating VSWR versus frequency curves of antenna device 106 according to the fourth exemplary embodiment over and around fundamental wave frequency band B1.
Figure 30:
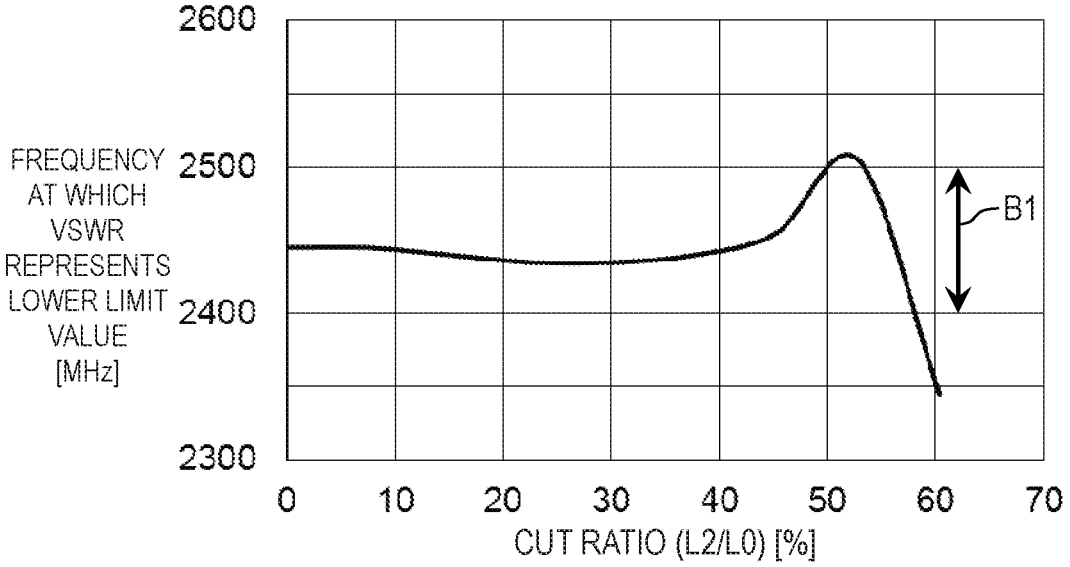
FIG. 30 is a graph illustrating a relationship observed in the VSWR versus frequency curves of FIG. 29 between the cut ratio of a printed wiring board and the frequency at which the VSWR for the cut ratio represents a lower limit value.

FIG. 29 is a graph illustrating VSWR versus frequency curves of antenna device 106 according to the fourth exemplary embodiment over and around fundamental wave frequency band B1. FIG. 29 shows waveforms for respective cut ratios 0% (equivalent to a comparative example), 7.5%, 15.1%, 22.6%, 30.2%, 37.7%, 45.3%, 52.8%, and 60.4%. FIG. 30 illustrates a relationship observed in the VSWR versus frequency curves of FIG. 29 between the cut ratio of printed wiring board 51 and the frequency at which the VSWR for the cut ratio represents a lower limit value. As is clear from FIGS. 29 and 30, when the cut ratio is less than or equal to 45%, the VSWR of antenna device 106 over fundamental wave frequency band B1 is less than or equal to 3, showing that antenna device 106 is capable of sending and receiving wireless signals in fundamental wave frequency band B1 with a loss less than or equal to a predetermined amount.

Figure 31:
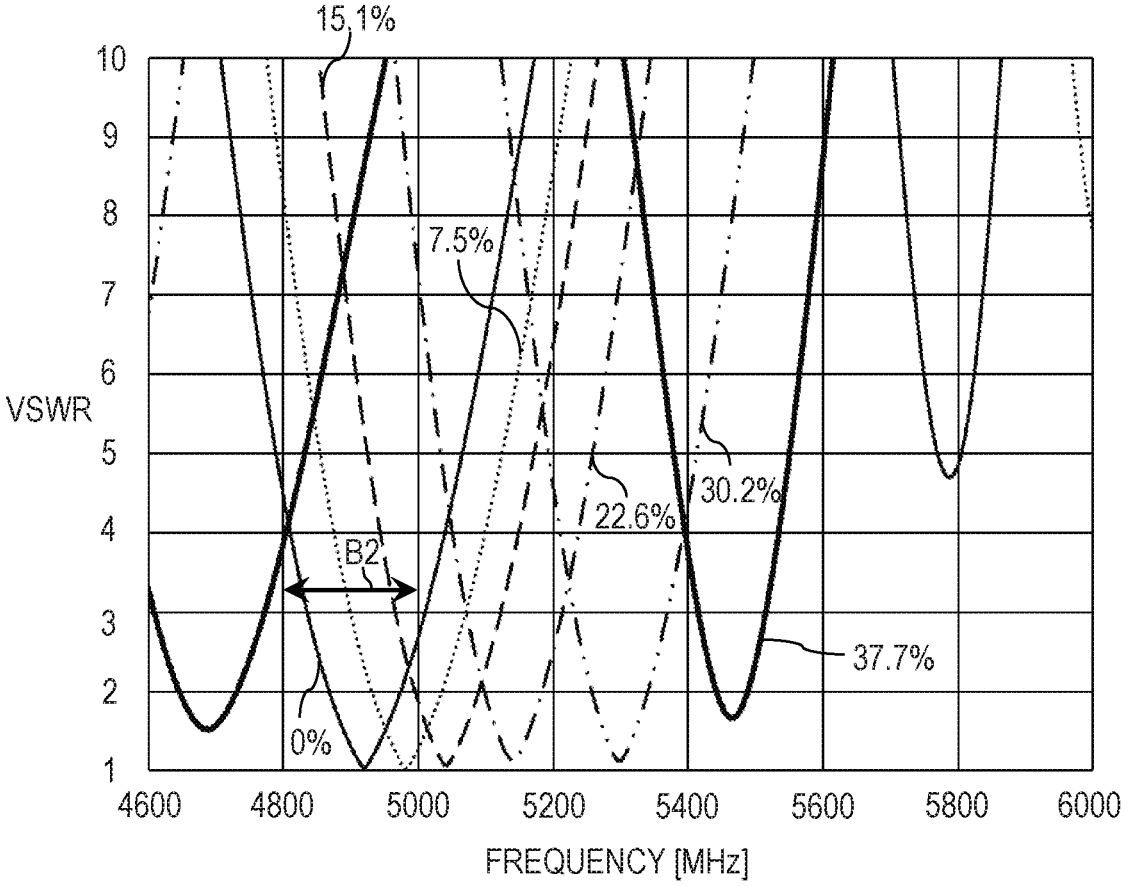
FIG. 31 is a graph illustrating VSWR versus frequency curves of antenna device 106 according to the fourth exemplary embodiment over and around second-order high frequency band B2.
Figure 32:
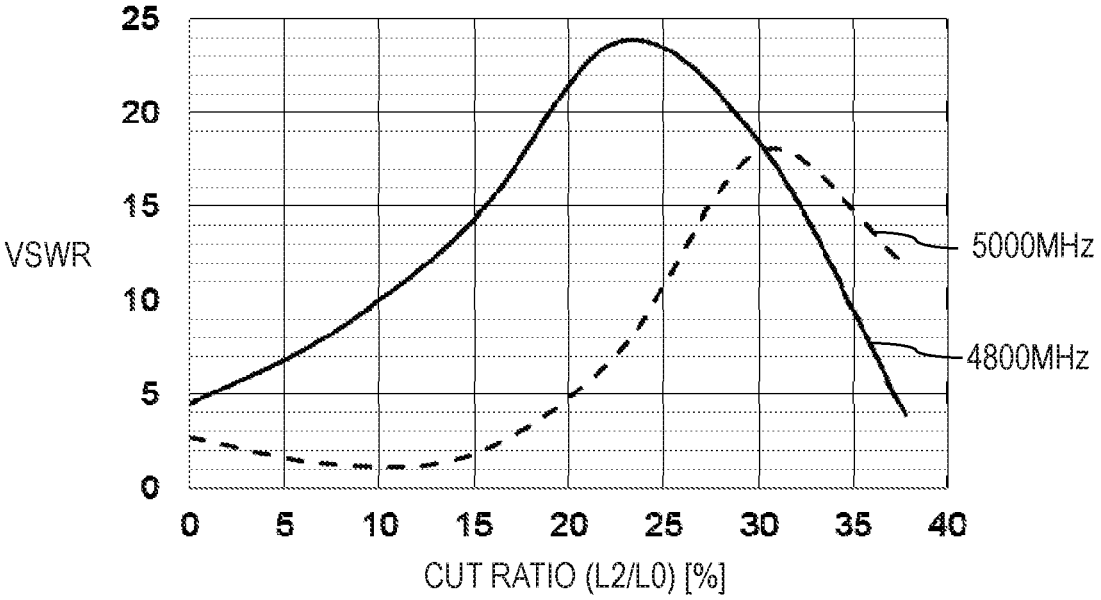
FIG. 32 is a graph illustrating relationships observed in the VSWR versus frequency curves of FIG. 31 between the cut ratio of the printed wiring board and the VSWRs in second-order high frequency band B2.

FIG. 31 is a graph illustrating VSWR versus frequency curves of antenna device 106 over and around second-order high frequency band B2. FIG. 31 shows waveforms for respective cut ratios 0% (equivalent to a comparative example), 7.5%, 15.1%, 22.6%, 30.2%, and 37.7%. FIG. 32 is a graph illustrating relationships observed in the VSWR versus frequency curves of FIG. 31 between the cut ratio of the printed wiring board and the VSWRs at 4800 MHz and 5000 MHz in second-order high frequency band B2.

As shown in FIG. 31, the waveforms representing VSWR versus frequency curves over and around second-order high frequency band B2 show a tendency to shift toward a higher frequency side along with an increase in the cut ratio of antenna device 106. As shown in FIG. 32, the VSWR at 4800 MHz, a lower frequency point in second-order high frequency band B2, is roughly greater than or equal to 6 when the cut ratio is in a range of 3% to 37%. The VSWR at 5000 MHz, a higher frequency point in second-order high frequency band B2, is roughly greater than or equal to 6 when the cut ratio is greater than or equal to 21%. This shows that when the cut ratio of printed wiring board 51 is in a range of 21% to 37%, the VSWR of antenna device 106 is roughly greater than or equal to 6 over second-order harmonic frequency band B2 and hence antenna device 106 is able to satisfactorily hinder the emission of wireless signals in second-order harmonic frequency band B2.

According to the fourth exemplary embodiment described above, since the cut part, which has none of the AMC and the ground conductors, is formed by cutting the part at the distal end of the printed wiring board, the antenna device is able to hinder the emission of wireless signals in second-order harmonic frequency band B2 while being capable of sending and receiving wireless signals in fundamental wave frequency band B1. This provides an antenna device that is capable of reducing influence of harmonics while maintaining a frequency response for fundamental waves.

In antenna device 106 described above, cut part 75 is formed on the side of antenna conductor 3. However, the cut part may be formed on the side of antenna conductor 2 such that the AMC and the ground conductors are shorter on the side of antenna conductor 2 than on the side of antenna conductor 3. An antenna device made in this way can produce effects similar to those of antenna device 106 described above.

AMC 57 and ground conductors 58, 59 of antenna device 106 have no openings on the side of antenna conductor 2 extending from the slit. However, at least one of AMC 57 and ground conductors 58, 59 may have any of openings 7*a*, 7*c*, 7*e*, 7*g*, 7*h*, 7*k*, 7*l*, 7*p*, 7*r*, 7*s*, 7*v*, 8*a*, 9*a* described in the first to the third exemplary embodiments and the first to the fourth modification examples. If an opening is formed in AMC 57 or ground conductors 58, 59 of antenna device 106, the range of the cut ratio in which the VSWR is roughly greater than or equal to 6 over second-order harmonic frequency band B2 can be broaden from the range of 21% to 37% shown in FIG. 32.

In antenna device 106, AMC 57 has slit 72. However, the AMC may have slit 71, 73, 74 described in the sixth to the eighth modification examples.

Other Exemplary Embodiments

In the Exemplary Embodiments and the Modification Examples Described above, the dipole antennas and the monopole antenna are taken as examples to illustrate technique disclosed in this patent application. However, the technique may be illustrated using any of other antennas such as inverted-L antennas and inverted-F antennas.

In the exemplary embodiments and the modification examples described above, the antenna devices are for use in the 2.4 GHz band. The antenna devices may be designed to operate in another frequency band.

In the exemplary embodiments and the modification examples described above, the antenna devices each include a multilayer substrate of printed wiring board 1. With proviso that antenna conductors 2, 3, the AMC, and the ground conductors are stacked in order and are disposed separately at predetermined intervals in the thickness direction, all or some of dielectric substrates 6, 11, 12, 13 may be, for example, replaced with an air layer. Each of the antenna devices according to the exemplary embodiments and the modification examples described above includes two ground conductors and may, however, include at least one ground conductor.

The ground conductors and the AMC may face one another and be disposed such that the ground conductors are inside the AMC or the AMC is inside the ground conductors in a plan view. This contributes to a reduction in the size of the antenna device.

In the first to the fourth exemplary embodiments and the first to the eighth modification examples described above, the AMC layers each have one to three slits. However, four or more slits may be formed or all or some of the plurality of slits may be joined together.

The exemplary embodiments and the modification examples described above are provided for exemplifying the technology of the present disclosure. Thus, various modifications, substitutions, additions, omissions, and the like can be made in the scope of claims or the equivalents thereof. In addition, new exemplary embodiments can be made by combining constituent elements described in the exemplary embodiments and the modification examples.

INDUSTRIAL APPLICABILITY

An antenna device according to the present disclosure can be readily incorporated in an electronic device. Thus, the antenna device, as an antenna for wireless equipment, can be applied to various electronic devices for use in personal computers, portable terminal devices, and conveyances (e.g., vehicles, buses, and airplanes).

What is claimed is:

1. An antenna device comprising:

two antenna conductors;

at least one ground conductor; and an artificial magnetic conductor that is located between the two antenna conductors and the at least one ground conductor and is disposed separately from the two antenna conductors and the at least one ground conductor, wherein:

at least one of the artificial magnetic conductor and the at least one ground conductor includes at least one opening formed at a place substantially facing a distal-side end of a first of the two antenna conductors, the distal-side end of the first of the two antenna conductors being opposite a feeder-side end of the first of the two antenna conductors;

the feeder-side end of the first of the two antenna conductors faces a feeder-side end of a second of the two antenna conductors; and the at least one opening is a cut part that is formed in the at least one of the artificial magnetic conductor and the at least one ground conductor by cutting a part extending from the place substantially facing the distal-side end of the first of the two antenna conductors to a distal end of the at least one of the artificial magnetic conductor and the at least one ground conductor.

2. The antenna device according to claim 1, wherein:

the at least one opening includes a first opening and a second opening;

the first opening is formed at the place substantially facing the distal-side end of the first of the two antenna conductors; and the second opening is formed at a place substantially facing a distal-side end of a second of the two antenna conductors, the distal-side end of the second of the two antenna conductors being opposite the feeder-side end of the second of the two antenna conductors.

3. The antenna device according to claim 1, wherein the at least one opening is formed in the artificial magnetic conductor.

4. The antenna device according to claim 1, wherein the at least one opening is formed in the at least one ground conductor.

5. The antenna device according to claim 1, wherein the at least one opening is formed in the artificial magnetic conductor so as to extend from the place substantially facing the distal-side end of the first of the two antenna conductors toward the distal end of the artificial magnetic conductor.

6. The antenna device according to claim 1, wherein:

the at least one opening includes a first opening and a second opening;

the first opening and the second opening are formed in the artificial magnetic conductor;

the first opening is formed at the place substantially facing the distal-side end of the first of the two antenna conductors; and the second opening extends toward the distal end of the artificial magnetic conductor from a place that is separated from the place substantially facing the distal-side end of the first of the two antenna conductors.

7. The antenna device according to claim 1, wherein a length of the cut part ranges from 21% to 37% inclusive of a length of the artificial magnetic conductor or the at least one ground conductor.

8. The antenna device according to claim 1, wherein the at least one ground conductor includes a plurality of ground conductors.

9. The antenna device according to claim 1, wherein:

the at least one ground conductor and the artificial magnetic conductor face each other; and the at least one ground conductor and the artificial magnetic conductor are disposed such that, in a plan view, the at least one ground conductor is inside the artificial magnetic conductor or the artificial magnetic conductor is inside the at least one ground conductor.

10. The antenna device according to claim 1, wherein the at least one ground conductor and the artificial magnetic conductor face each other and are disposed so as to substantially cover each other in a plan view.

11. The antenna device according to claim 1, wherein the at least one ground conductor is substantially rectangular.

12. The antenna device according to claim 1, wherein a longitudinal edge of the at least one ground conductor is formed so as to face and cover a longitudinal edge of the artificial magnetic conductor.

* * * * *